US010233512B2

(12) United States Patent
Ueda et al.

(10) Patent No.: US 10,233,512 B2
(45) Date of Patent: Mar. 19, 2019

(54) RAIL AND PRODUCTION METHOD THEREFOR

(71) Applicant: NIPPON STEEL & SUMITOMO METAL CORPORATION, Tokyo (JP)

(72) Inventors: Masaharu Ueda, Kitakyushu (JP); Teruhisa Miyazaki, Kitakyushu (JP); Takuya Tanahashi, Kitakyushu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 174 days.

(21) Appl. No.: 15/306,962

(22) PCT Filed: May 29, 2015

(86) PCT No.: PCT/JP2015/065551
§ 371 (c)(1),
(2) Date: Oct. 26, 2016

(87) PCT Pub. No.: WO2015/182743
PCT Pub. Date: Dec. 3, 2015

(65) Prior Publication Data

US 2017/0044634 A1 Feb. 16, 2017

(30) Foreign Application Priority Data

May 29, 2014 (JP) ..... 2014-111734

(51) Int. Cl.
*C21D 8/00* (2006.01)
*C21D 9/04* (2006.01)
(Continued)

(52) U.S. Cl.
CPC ..... *C21D 9/04* (2013.01); *C21D 8/005* (2013.01); *C22C 38/00* (2013.01); *C22C 38/001* (2013.01);
(Continued)

(58) Field of Classification Search
CPC ..... C21D 9/04; C21D 9/8005; C22C 38/00; C22C 38/001; C22C 38/002;
(Continued)

(56) References Cited

U.S. PATENT DOCUMENTS 5,382,307 A * 1/1995 Kageyama ..... C21D 1/20 148/320
5,645,653 A * 7/1997 Jerath ..... C21D 9/04 148/320
(Continued)

FOREIGN PATENT DOCUMENTS

CA 1328648 C 4/1994
CA 2225240 A1 6/1998
(Continued)

OTHER PUBLICATIONS

International Search Report for PCT/JP2015/065551 dated Aug. 18, 2015.
(Continued)

*Primary Examiner* — Jason C Smith
(74) *Attorney, Agent, or Firm* — Birch, Stewart, Kolasch & Birch, LLP

(57) ABSTRACT

A rail provided by the present invention includes: has a predetermined chemical components, wherein a value of Mn/Cr, which is a ratio of Mn content with respect to Cr content, is within a range of 0.30 to 1.00, structures in a region from a head surface constituted of a surface of a top head portion and a surface of a corner head portion to a depth of 10 mm is 98% by area or more of bainite structures, and an average hardness of the region from the head surface to a depth of 10 mm is in a range of Hv 380 to Hv 500.

6 Claims, 7 Drawing Sheets

(51) Int. Cl.

| | |
|---|---|
| ***E01B 5/08*** | (2006.01) |
| ***C22C 38/00*** | (2006.01) |
| ***C22C 38/02*** | (2006.01) |
| ***C22C 38/04*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/40*** | (2006.01) |
| ***C22C 38/54*** | (2006.01) |

(52) U.S. Cl.
CPC ..... *C22C 38/002* (2013.01); *C22C 38/005* (2013.01); *C22C 38/02* (2013.01); *C22C 38/04* (2013.01); *C22C 38/20* (2013.01); *C22C 38/22* (2013.01); *C22C 38/26* (2013.01); *C22C 38/28* (2013.01); *C22C 38/30* (2013.01); *C22C 38/32* (2013.01); *C22C 38/40* (2013.01); *C22C 38/54* (2013.01); *E01B 5/08* (2013.01); *C21D 2211/001* (2013.01); *C21D 2211/002* (2013.01)

(58) Field of Classification Search
CPC ..... C22C 38/005; C22C 38/02; C22C 38/04; C22C 38/20; C22C 38/22; C22C 38/26; C22C 38/28; C22C 38/30; C22C 38/32; C22C 38/40
See application file for complete search history.

(56) References Cited

U.S. PATENT DOCUMENTS

| | | | | |
|---|---|---|---|---|
| 7,288,159 | B2 * | 10/2007 | Cordova | C21D 9/04 148/320 |
| 2011/0155821 | A1 * | 6/2011 | Ueda | C21C 7/0025 238/150 |
| 2011/0226389 | A1 * | 9/2011 | Ueda | C21D 9/04 148/330 |
| 2011/0303756 | A1 * | 12/2011 | Ueda | C21D 9/04 238/150 |
| 2013/0065079 | A1 * | 3/2013 | Ueda | C21D 9/04 428/638 |
| 2015/0069141 | A1 * | 3/2015 | Ueda | C21D 9/04 238/150 |
| 2015/0136864 | A1 * | 5/2015 | Ueda | C21D 9/04 238/150 |
| 2015/0188512 | A1 | 7/2015 | Michigami | |
| 2016/0060736 | A1 * | 3/2016 | Han | C22C 38/12 148/584 |
| 2017/0044634 | A1 * | 2/2017 | Ueda | C21D 9/04 |
| 2017/0101692 | A1 * | 4/2017 | Kimura | C21D 9/04 |
| 2017/0233843 | A1 * | 8/2017 | Kijima | C21D 9/0062 148/581 |
| 2017/0283895 | A1 * | 10/2017 | Okushiro | C21D 9/04 |
| 2017/0349986 | A1 * | 12/2017 | Froman | C22C 38/42 |
| 2017/0369961 | A1 * | 12/2017 | Ueda | C21D 9/04 |
| 2017/0369975 | A1 * | 12/2017 | Ueda | C22C 38/24 |

FOREIGN PATENT DOCUMENTS

| | | | |
|---|---|---|---|
| JP | 8-92645 | A | 4/1996 |
| JP | 8-92696 | A | 4/1996 |
| JP | 10-280098 | A | 10/1998 |
| JP | 3114490 | B2 | 12/2000 |
| JP | 3253852 | B2 | 2/2002 |
| JP | 3267124 | B2 | 3/2002 |
| JP | 2010-77481 | A | 4/2010 |
| JP | 2013-224471 | A | 10/2013 |
| JP | 5459453 | B1 | 4/2014 |
| JP | 5482972 | B1 | 5/2014 |
| JP | 5482974 | B1 | 5/2014 |
| WO | WO 2014-049032 | A1 | 4/2014 |
| WO | WO 2014/050219 | A1 | 4/2014 |

OTHER PUBLICATIONS

Written Opinion of the International Searching Authority for PCT/JP2015/065551 (PCT/ISA/237) dated Aug. 18, 2015.
Canadian Office Action dated Dec. 1, 2017, for corresponding Canadian Application No. 2,946,541.
Japanese Office Action issued in Japanese Application No. 2016-523574 dated Jul. 4, 2017, together with an English translation.

* cited by examiner

RAIL AND PRODUCTION METHOD THEREFOR

TECHNICAL FIELD OF THE INVENTION

The present invention relates to a rail and a production method therefor and, particularly, relates to a high-strength rail intended to improve surface damage resistance and wear resistance which are required when the rail is used for freight railways and a production method therefor.

Priority is claimed on Japanese Patent Application No. 2014-111734, filed on May 29, 2014, the content of which is incorporated herein by reference.

RELATED ART

In accordance with economic advancement, new developments of natural resources such as coal are underway. Specifically, mining of natural resources in districts with harsh natural environments which have not yet been developed is underway. Accordingly, environments in which rails for freight railways for transporting mined natural resources are used have become significantly harsh. Particularly, for rails used for freight railways, there has been a demand for surface damage resistance that is stronger than ever. The surface damage resistance of rails refers to a characteristic indicating resistance to the generation of damage on rail surfaces (particularly, the surfaces of rail head portions which are contact sections between rails and wheels).

In order to improve the surface damage resistance of steel used for rails (hereinafter, also referred to as rail steel), in the related art, rails having bainite structures as described below have been developed. A major characteristic of these rails of the related art is that bainite structures are provided as the main structure of the rails by means of the control of chemical components and a heat treatment and wear of rail head portions which are contact sections between rails and wheels is accelerated. Since wear of rail head portions eliminate damage generated on rail head portions, the acceleration of wear improves the surface damage resistance of rail head portions.

Patent Document 1 discloses a rail which is obtained by accelerated-cooling steel, of which the amount of carbon (C: 0.15% to 0.45%) is relatively small in the technical field of rail steel, from an austenite range temperature at a cooling rate of 5° C./sec to 20° C./sec and forming bainite structures as a structure thereof and has improved surface damage resistance.

Patent Document 2 discloses a rail having improved surface damage resistance which is obtained by forming bainite structures in steel, of which the amount of carbon (C:0.15% to 0.55%) is relatively small in the technical field of rail steel, and furthermore, on which an alloy design for controlling the intrinsic resistance value of rails is carried out.

As described above, in the techniques disclosed by Patent Documents 1 and 2, bainite structures are formed in rail steel, and wear of rail head portions is accelerated, thereby improving the surface damage resistance to a certain extent. However, in freight railways, recently, railway transportation has become busier, and wear of rail head portions has been accelerated, and thus there has been a demand for additional improvement in the service life of rails by means of improvement in wear resistance. The wear resistance of rails refers to a characteristic indicating resistance to the occurrence of wear.

Therefore, there has been a demand for the development of rails improved in terms of both surface damage resistance and wear resistance. In order to solve this problem, in the related art, high-strength rails having bainite structures as described below have been developed. In these rails of the related art, in order to improve wear resistance, alloys of Mn, Cr, and the like are added, the transformation temperature of bainite is controlled, and the hardness is improved (for example, see Patent Documents 3 and 4).

Patent Document 3 discloses a technique for increasing the amounts of Mn and Cr and controlling the hardness of rail steel to be Hv 330 or higher in steel of which the amount of carbon (C:0.15% to 0.45%) is relatively small in the technical field of rail steel.

Patent Document 4 discloses a technique for increasing the amounts of Mn and Cr, furthermore, adding Nb, and controlling the hardness of rail steel to be Hv 400 to Hv 500 in steel of which the amount of carbon (C:0.15% to 0.50%) is relatively small in the technical field of rail steel.

As described above, in the techniques of Patent Documents 3 and 4, wear resistance is improved to a certain extent by increasing the hardness of rail steel. However, the rails disclosed in Patent Documents 3 and 4 cannot sufficiently solve the above-described problems of the rail for recent freight railways.

Therefore, there has been a demand for the development of new high-strength rails improved in terms of surface damage resistance and wear resistance which are required for rails for freight railways.

PRIOR ART DOCUMENT

Patent Document

[Patent Document 1] Japanese Patent No. 3253852

[Patent Document 2] Japanese Patent No. 3114490

[Patent Document 3] Japanese Unexamined Patent Application, First Publication No. H8-92696

[Patent Document 4] Japanese Patent No. 3267124

DISCLOSURE OF THE INVENTION

Problems to be Solved by the Invention

The present invention has been made in consideration of the above-described problems, and an object thereof is to provide a rail improved in terms of both surface damage resistance and wear resistance which are required particularly for rails used in freight railways and a production method therefor.

Means for Solving the Problem

In order to achieve the above-described object, the present inventors carried out intensive studies regarding chemical components, structures, and the like which enable the obtainment of rails having excellent surface damage resistance and wear resistance and completed the present invention.

The gist of the present invention is as follows.

(1) A rail according to an aspect of the present invention includes: a rail head portion having a top head portion which is a flat region extending toward a top portion of the rail head portion in a extending direction of the rail, a side head portion which is a flat region extending toward a side portion of the rail head portion in the extending direction of the rail, and a corner head portion which is a region combining a rounded corner portion extending between the top head portion and the side head portion and an upper half of the side head portion, wherein the rail contains as a chemical components, in terms of mass %: C: 0.70% to 1.00%, Si: 0.20% to 1.50%, Mn: 0.30% to 1.00%, Cr: 0.50% to 1.30%, P: 0.0250% or less, S: 0.0250% or less, Mo: 0% to 0.50%, Co: 0% to 1.00%, Cu: 0% to 1.00%, Ni: 0% to 1.00%, V: 0% to 0.300%, Nb: 0% to 0.0500%, Mg: 0% to 0.0200%, Ca: 0% to 0.0200%, REM: 0% to 0.0500%, B: 0% to 0.0050%, Zr: 0% to 0.0200%, N: 0% to 0.0200%, and a remainder of Fe and impurities, wherein a value of Mn/Cr, which is a ratio of Mn content with respect to Cr content, is within a range of 0.30 to 1.00, wherein structures in a region from a head surface constituted of a surface of the top head portion and a surface of the corner head portion to a depth of 10 mm includes 98% by area or more of bainite structures, and wherein an average hardness of the region from the head surface to a depth of 10 mm is in a range of Hv 380 to Hv 500.

(2) The rail according to (1) may contain as the chemical components, in terms of mass %, one or more selected from the group consisting of: Mo: 0.01% to 0.50%, Co: 0.01% to 1.00%, Cu: 0.05% to 1.00%, Ni: 0.05% to 1.00%, V: 0.005% to 0.300%, Nb: 0.0010% to 0.0500%, Mg: 0.0005% to 0.0200%, Ca: 0.0005% to 0.0200%, REM: 0.0005% to 0.0500%, B: 0.0001% to 0.0050%, Zr: 0.0001% to 0.0200%, and N: 0.0060% to 0.0200%.

(3) A production method for a rail according to another aspect of the present invention includes: hot-rolling a bloom or a slab containing the chemical components according to (1) or (2) in a rail shape to obtain a material rail, accelerated-cooling the head surface of the material rail from a temperature region of 700° C. or higher which is a temperature region that is equal to or higher than a transformation start temperature from austenite to a temperature region of 350° C. to 500° C. at a cooling rate of 3.0° C./sec to 20.0° C./sec after the hot-rolling, holding a temperature of the head surface of the material rail in the temperature region of 350° C. to 500° C. for 100 sec to 800 sec after the accelerated-cooling, and naturally-cooling or further accelerated-cooling the material rail to room temperature after the holding.

(4) The production method for a rail according to (3) may further include: preliminarily-cooling the hot-rolled rail and then reheating the head surface of the material rail to an austenite transformation completion temperature+30° C. or higher between the hot-rolling and the accelerated-cooling.

Effects of the Invention

According to the present invention, the surface damage resistance and the wear resistance of rails used in freight railways are improved by controlling the chemical components and structures of rail steel, and furthermore, controlling the hardness of rail head portions, whereby it becomes possible to significantly improve the service life of rails.

EMBODIMENTS OF THE INVENTION

Figure 1:
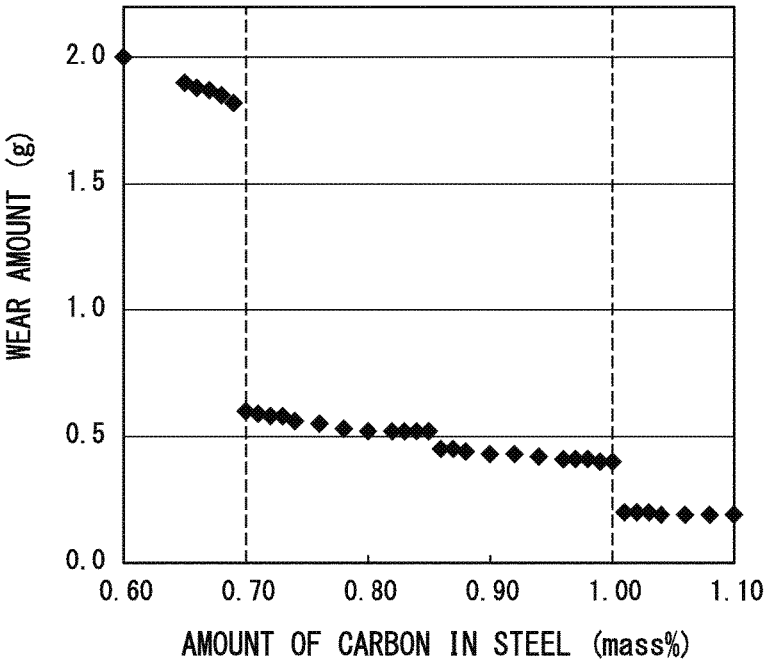
FIG. 1 is a graph showing a relationship between an amount of carbon in steel and a wear amount in test rails (test steel group A).

Hereinafter, a rail having excellent surface damage resistance and excellent wear resistance will be described in detail as an embodiment of the present invention.

Hereinafter, the unit "mass %" of the amounts of chemical components will be simply denoted as "%".

(1. Relationship Between Amount of Carbon and Wear Resistance)

First, the present inventors studied about a method for improving the wear resistance of bainite steel used for rails. The present inventors considered that it is effective for improving wear resistance to use carbides, and the present inventors produced a variety of steel ingots in which the structures of the head surface portions are mixed structures of pearlite structures and bainite structures and the amounts of carbon in steel are different from each other in a laboratory, and hot rolled the steel ingots, thereby producing material rails. Furthermore, the present inventors carried out a heat treatment on the head surface portions of the material rails, produced test rails (test steel group A), and carried out a variety of evaluations. Specifically, the hardness and structures of the head surface portions of the test rails were measured, and two-cylinder wear tests were carried out on cylindrical test specimens cut out from the head surface portions of the test rails, thereby evaluating the wear resistance of the test rails. Meanwhile, the chemical components, heat treatment conditions, and wear test conditions of test steel group A are as described below.

<Chemical Components of Test Steel Group A>

C: 0.60% to 1.10%;

Si: 0.50%;

Mn: 0.60%

Cr: 1.00%;

P: 0.0150%;

S: 0.0120%; and a remainder: Fe and impurities

The following heat treatment was carried out on steel having the above-described chemical components, thereby producing test steel group A (rails).

<Heat Treatment Conditions of Test Steel Group A>

Heating temperature: 950° C. (temperature of austenite transformation completion temperature+30° C. or higher)

Holding time at the above-described heating temperature: 30 min

Cooling conditions: After the above-described holding time elapsed, the rails were cooled to 400° C. at a cooling rate of 8° C./sec, were held at 400° C. for 200 sec to 500 sec, and were naturally-cooled to room temperature.

<Structure Observation Method for Test Steel Group A>

Pretreatment: Cross sections perpendicular to the rolling direction were diamond-polished, and then were etched using 3% Nital.

Structure observation: An optical microscope was used.

Measurement method for bainite area ratios: The bainite area ratios at 20 places at depth of 2 mm from the head surfaces of the test rails and the bainite area ratios at 20 places at depth of 10 mm from the head surfaces were obtained on the basis of optical microscopic photographs, and the area ratios were averaged, thereby obtaining the pearlite area ratios and the bainite area ratios.

<Hardness Measurement Method for Test Steel Group A>

Pretreatment: Cross sections were diamond-polished.

Device: A Vickers hardness tester was used (the load was 98 N).

Measurement method: Measured according to JIS Z 2244.

Measurement method for hardness: Hardness at 20 places at depth of 2 mm from the head surfaces of the test rails and hardness at 20 places at depth of 10 mm from the head surfaces were obtained, and the hardness values were averaged, thereby obtaining the hardness.

<Hardness and Structure of Test Steel Group A>

Hardness: Hv 400 to Hv 440

Structure: 98% by area or more of bainite, pearlite, pro-eutecitoid ferrite, pro-eutecitoid cementite, and martensite were included.

Meanwhile, the above-described "austenite transformation completion temperature" refers to a temperature at which, in a process of heating steel from a temperature region of 700° C. or lower, transformation from ferrite and/or cementite to austenite is completed. The austenite transformation completion temperature of hypo-eutectoid steel is an $Ac_3$ point (a temperature at which transformation from ferrite to austenite is completed), the austenite transformation completion temperature of hyper-eutectoid steel is an $Ac_{cm}$ point (a temperature at which transformation from cementite to austenite is completed), and the austenite transformation completion temperature of eutectoid steel is an $Ac_1$ point (a temperature at which transformation from ferrite and cementite to austenite is completed). The austenite transformation completion temperature varies depending on the amount of carbon and the chemical components of steel. In order to accurately obtain the austenite transformation completion temperature, verification by means of tests is required. However, in order to simply obtain the austenite transformation completion temperature, the austenite transformation completion temperature may be obtained from the Fe—$Fe_3C$-based equilibrium diagram described in metallurgy textbooks (for example, "Iron and Steel Materials", The Japan Institute of Metals and Materials) on the basis of the amount of carbon alone. Meanwhile, within the ranges of the chemical components of the rail according to the present embodiment, the austenite transformation completion temperature is generally in a range of 720° C. to 900° C.

Wear test specimens were cut out from the head portions of the rails, and the wear resistance of the rails was evaluated.

<Method for Carrying Out Wear Test>

Tester: Nishihara-type wear tester (see FIG. 11)

Test specimen shape: Cylindrical test specimen (outer diameter: 30 mm, thickness: 8 mm), a rail material 4 in FIG. 11

Test specimen-sampling method: Cylindrical test specimens were cut out from the head surface portions of the test rails so that the upper surfaces of the cylindrical test specimens were located 2 mm below the head surfaces of the test rails and the lower surfaces of the cylindrical test specimens were located 10 mm below the head surfaces of the test rails (see FIG. 10)

Contact surface pressure: 840 MPa

Slip ratio: 9%

Opposite material: Pearlite steel (Hv 380), a wheel material 5 in FIG. 11

Test atmosphere: Air atmosphere

Figure 11:
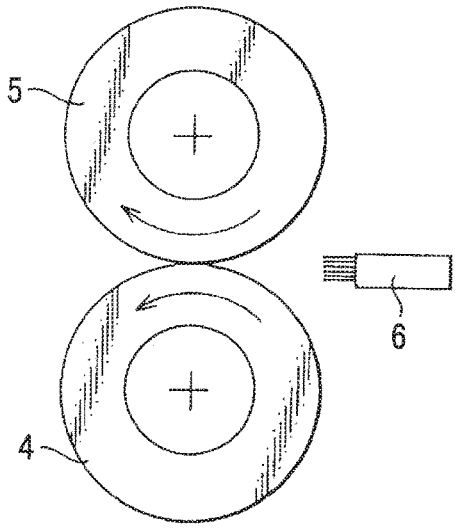
FIG. 11 is a schematic side view showing an outline of the wear test (Nishihara-type wear tester).

Cooling method: forced cooling using compressed air in which a cooling air nozzle 6 in FIG. 11 was used (flow rate: 100 Nl/min).

The number of repetitions: 500,000 times

FIG. 1 shows the relationship between the amount of carbon in steel and the wear amount in the test rails (test steel group A). It was clarified from the graph of FIG. 1 that the wear amounts of steels have a correlation with the amount of carbon in the steel, and the wear resistance is significantly improved by an increase in the amount of carbon in the steel. Particularly, in steel having an amount of carbon of 0.70% or more, it was confirmed that the wear amount significantly decreases, and the wear resistance of the steel significantly improves.

(2. Relationship Between Amount of Carbon and Surface Damage Resistance)

Furthermore, the present inventors evaluated the surface damage resistance of the rails using a method in which an actual wheel was repeatedly brought into rolling contact with and was rolled on the test rails (test steel group A) (rolling contact fatigue test). Meanwhile, the rolling test conditions were as described below.

<Method for Carrying Out Rolling Contact Fatigue Test>

Tester: A rolling contact fatigue tester (see FIG. 12)

Test specimen shape: A rail (2 m 141 pound rail), a test rail 8 in FIG. 12

Wheel: Association of American Railroads (AAR)-type (diameter: 920 mm), a wheel 9 in FIG. 12

Radial load and Thrust load: 50 kN to 300 kN, and 20 kN, respectively

Lubricant: Dry+oil (intermittent oil supply)

The number of repetation: Until damage was generated (in a case in which damage was not generated, a maximum of 2.0 million times of rolling)

Figure 2:
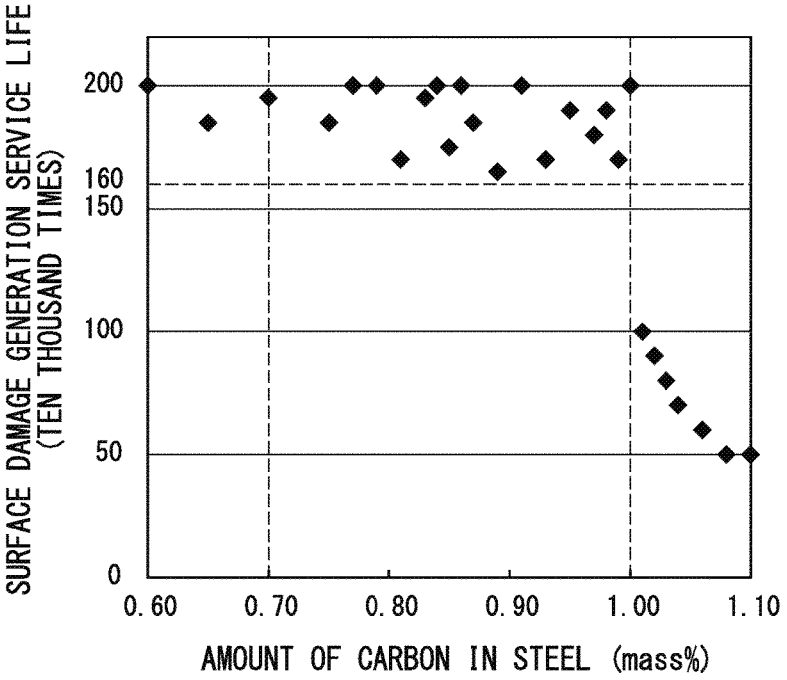
FIG. 2 is a graph showing a relationship between the amount of carbon in steel and a surface damage generation service life in the test rails (test steel group A).

In the rolling contact fatigue test, the number of times of rolling until surface damage was generated in the test rail 8 was obtained, and this number was considered to be the surface damage generation service life of the test rail 8. The surface damage generation service life of the test rail 8 in which no surface damage was generated due to 2.0 million times of rolling was considered to be "2.0 million times or more". The presence or absence of the generation of surface damage was determined by visually observing the full length of the rolling contact surface of the test rail. Rails in which 1 mm or longer cracking or 1 mm or wider exfoliation occurred were considered to be rails in which surface damage was generated. FIG. 2 shows the relationship between the amount of carbon in steel and the surface damage generation service life in the test rails (test steel group A).

As is clear from the graph of FIG. 2, it was found that the surface damage generation service life of the head surface portions of the rails has a correlation with the amount of carbon in steel. In addition, it was confirmed that, when the amount of carbon in steel exceeds 1.00%, the wear amounts of the head surface portions of the rails are further reduced as shown in FIG. 1, and the wear acceleration effect of the head surface portions are reduced. Therefore, as shown in FIG. 2, it was confirmed that, when the amount of carbon in steel exceeds 1.00%, the surface damage generation service life is reduced due to the generation of rolling contact fatigue damage, and the surface damage resistance significantly degrades.

From the above-described results, it became clear that, in order to improve the wear resistance as well as to ensure surface damage resistance of head surface portions of rails, it is necessary to set the amount of carbon in steel in a certain range.

(3. Relationship Between Area Ratio of Bainite Structures and Surface Damage Resistance)

In order to further enhance surface damage resistance of head surface portion of rail, the present inventors studied effects of the structures other than bainite structures on characteristics of rail (i.e. effects of the area ratio of bainite structures on characteristics of steel). The inventors evaluated the surface damage resistance by means of rolling contact tests on the test rails in which the area ratio of bainite structures (i.e. the area ratio of bainite structures in regions from head surface to a depth of 10 mm) were varied within a range of 85% to 100% and the amounts of carbon were 0.70%, 0.85%, or 1.00% (test steel groups B1 to B3). The chemical components, heat treatment conditions, and rolling contact fatigue test conditions of test steel groups B1 to B3 are as described below.

<Chemical Components of Test Steel Groups B1 to B3>

C: 0.70% (test steel group B1), 0.85% (test steel group B2), or 1.00% (test steel group B3);

Si: 0.50%;

Mn: 0.60%

Cr: 1.00%;

P: 0.0150%;

S: 0.0120%; and a remainder: Fe and impurities

The following heat treatment was carried out on steel having the above-described chemical components, thereby producing test steel groups B1 to B3 (rails).

<Heat Treatment Conditions of Test Steel Groups B1 to B3>

Heating temperature: 950° C. (temperature of austenite transformation completion temperature+30° C. or higher)

Holding time at the above-described heating temperature: 30 min

Cooling conditions: After the above-described holding time elapsed, the rails were cooled to a temperature range of 200° C. to 600° C. at a cooling rate of 8° C./sec, were reheated to 400° C. if the cooling was carried out until a temperature range of less than 400° C., were held at 400° C. for 200 sec to 500 sec, furthermore, and were naturally-cooled to room temperature.

<Structure Observation Method for Test Steel Groups B1 to B3>

Identical to the above-described structure observation method for test steel group A <Hardness Measurement Method for Test Steel Groups B1 to B3>

Identical to the above-described hardness measurement method for test steel group A <Structure and Hardness of Test Steel Groups B1 to B3>

Hardness: Hv 400 to Hv 440

Structure: 80 to 100% by area of bainite structures, pearlite structures, pro-eutecitoid ferrite structures, pro-eutecitoid cementite structures, and martensite structures The surface damage resistance of the rails were evaluated using a method (rolling contact fatigue test) in which an actual wheel was repeatedly brought into rolling contact with and was rolled on head portions of test steel groups B1 to B3 (rails).

<Method for Carrying Rolling Contact Fatigue Test>

Figure 3:
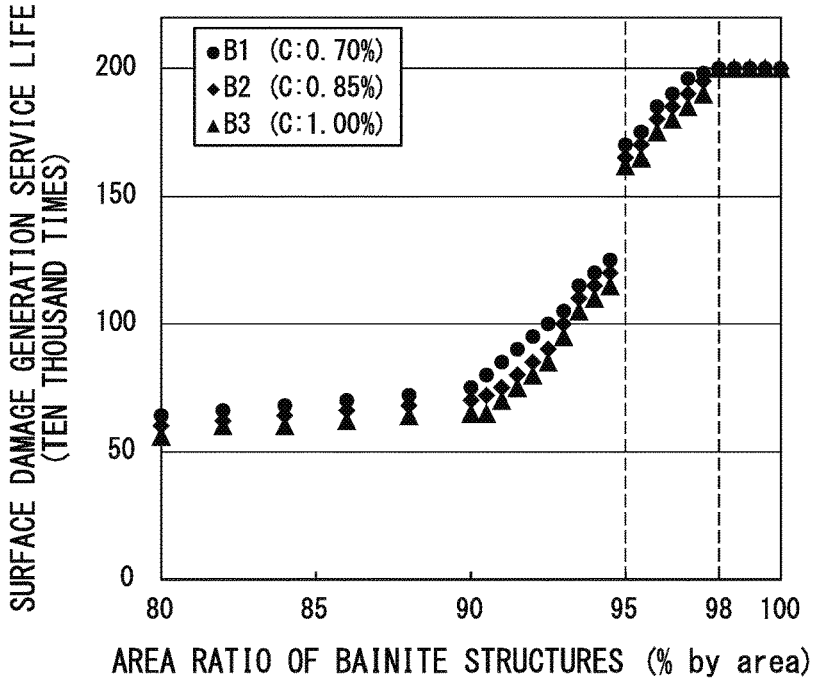
FIG. 3 is a graph showing relationships between an area ratio of bainite structures and a surface damage generation service life of head surface portions of rails in test rails (test steel groups B1 to B3).

Identical to the above-described rolling contact fatigue test method carried out on test steel group A FIG. 3 shows the relationships between the area ratio of the bainite structures and the surface damage generation service life of the head surface portions of the rails in the test rails (test steel groups B1 to B3). From the graph of FIG. 3, it is found that, in all test steel groups B1 to B3, there is a correlation between the area ratios of the bainite structures and the surface damage generation service life, and in a case in which the area ratio of the bainite structure is 98% or more, the surface damage generation service life is sufficiently increased. From the above-described results, it became clear that, in order to significantly improve the surface damage resistance of the head surface portion of the rail, it is necessary to control the amount of carbon in steel and to control the area ratio of the bainite structures to be in a predetermined range.

(4. Relationship Between Hardness and Surface Damage Resistance)

Furthermore, in order to understand the influence of the hardness of the head surface portion of the rail on the surface damage resistance in the head surface portion of the rail, the present inventors produced test rails in which hardness was differentiated, the amount of carbon was set to 0.70%, 0.85%, or 1.00% (test steel groups B1' to B3') and evaluated the surface damage resistance of these test rails by means of rolling contact fatigue tests. Meanwhile, chemical components, heat treatment conditions, and rolling contact fatigue test conditions of test steel groups B1' to B3' are as described below.

<Chemical Components of Test Steel Groups B1' to B3'>

Identical to that of the above-described test steel groups B1 to B3

<Heat Treatment Conditions of Test Steel Groups B1' to B3'>

Heating temperature: 950° C. (temperature of austenite transformation completion temperature+30° C. or higher)

Holding time at the above-described heating temperature: 30 min

Cooling conditions: After the above-described holding time elapsed, the rails were cooled to a temperature range of 300° C. to 550° C. at a cooling rate of 8° C./sec, were reheated as may be necessary, were held within a temperature range of 300° C. to 550° C. for 100 sec to 800 sec, and were naturally-cooled to room temperature.

<Structure Observation Method for Test Steel Groups B1' to B3'>

Identical to the above-described structure observation method for test steel group A <Hardness Measurement Method for Test Steel Groups B1' to B3'>

Identical to the above-described structure observation method for test steel group A <Structure and Hardness of Test Steel Groups B1' to B3'>

Hardness: Hv 340 to Hv 540

Structure: 98% by area or more of bainite structures, pearlite structures, pro-eutecitoid ferrite structures, pro-eutecitoid cementite structures, and martensite structures <Method for Carrying Out Rolling Contact Fatigue Tests>

Figure 4:
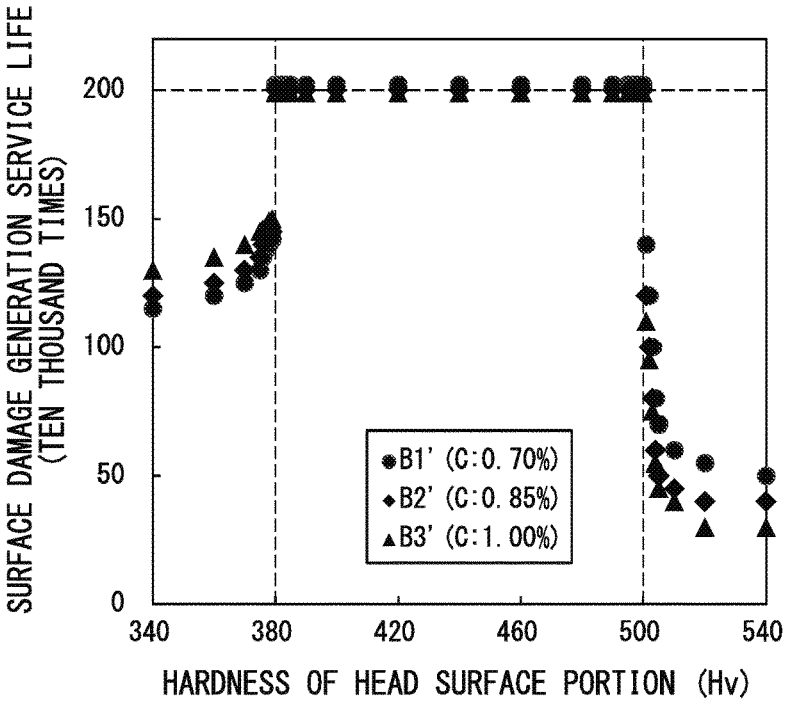
FIG. 4 is a graph showing relationships between hardness and a surface damage generation service life of head surface portions of rails in test rails (test steel groups B1' to B3').

Identical to the above-described method for carrying out rolling fatigue tests carried out on test steel group A FIG. 4 shows the relationships between the hardness and the surface damage generation service life of the head surface portions of the rails in test rails (test steel groups B1' to B3'). From the graph of FIG. 4, in all test steel groups B1' to B3', it is found that there is a correlation between the surface damage generation service life and the hardness of the head surface portions of the rails, and if the hardness of the head surface portions of the rails exceeds Hv 500, the wear acceleration effect of the head surface portions of the rails is reduced, the surface damage generation service life of the head surface portions of the rails is reduced due to the generation of rolling contact fatigue damage, and the surface damage resistance of the head surface portions of the rails significantly degrades. On the other hand, it was confirmed that, if the hardness of the head surface portions of the rails is lower than Hv 380, plastic deformation develops on rolling contact surfaces, the generation of rolling contact fatigue damage attributed to the plastic deformation reduces surface damage generation service life, and the surface damage resistance significantly degrades. In addition, all of the samples of which the hardness of the head surface portions of the rails were Hv 380 to Hv 500 had 2.0 million times or more of surface damage generation service life, From the above-described results, it became clear that, in order to ensure surface damage resistance as well as to enhance wear resistance, it is necessary to control the amount of carbon and structure in head surface portion of the rail, and furthermore, to control the hardness in a predetermined range.

(5. Relationship Between Mn/Cr and an Area Ratio of Bainite Structures)

Furthermore, the present inventors studied a ratio of Mn content and Cr content in order to stably generate bainite structures in steel having chemical components in which C content is high. Material rails in which the carbon content were 0.70%, 0.85%, or 1.00%, a total of Mn content and Cr content were 1.6%, and a ratio of Mn content and Cr content were varied were produced in a laboratory, test rails (test steel groups C1 to C3) were produced from the steels, and a relationship between Mn content and Cr content, and structure was studied. Meanwhile, the chemical components, and heat treatment conditions of test steel groups C1 to C3 are as described below.

<Chemical Components of Test Steel Groups C1 to C3>

C: 0.70% (test steel group C1), 0.85% (test steel group C2), or 1.00% (test steel group C3);

Si: 0.50%;

Mn: 0.30% to 1.00%

Cr: 0.60% to 1.30%;

P: 0.0150%;

S: 0.0120%; and a remainder: Fe and impurities, in which Mn+Cr=1.60%.

The following heat treatment was carried out on steel having the above-described chemical components, thereby producing the test steel groups C1 to C3 (rails).

<Heat Treatment Conditions of Test Steel Groups C1 to C3>

Heating temperature: 950° C. (temperature of austenite transformation completion temperature+30° C. or higher)

Holding time at the above-described heating temperature: 30 min

Cooling conditions: After the above-described holding time elapsed, the rails were cooled to 420° C. at a cooling rate of 8° C./sec, then, were held at 420° C. for 100 sec to 800 sec, and were naturally-cooled to room temperature.

<Structure Observation Method for Test Steel Groups C1 to C3>

Figure 5:
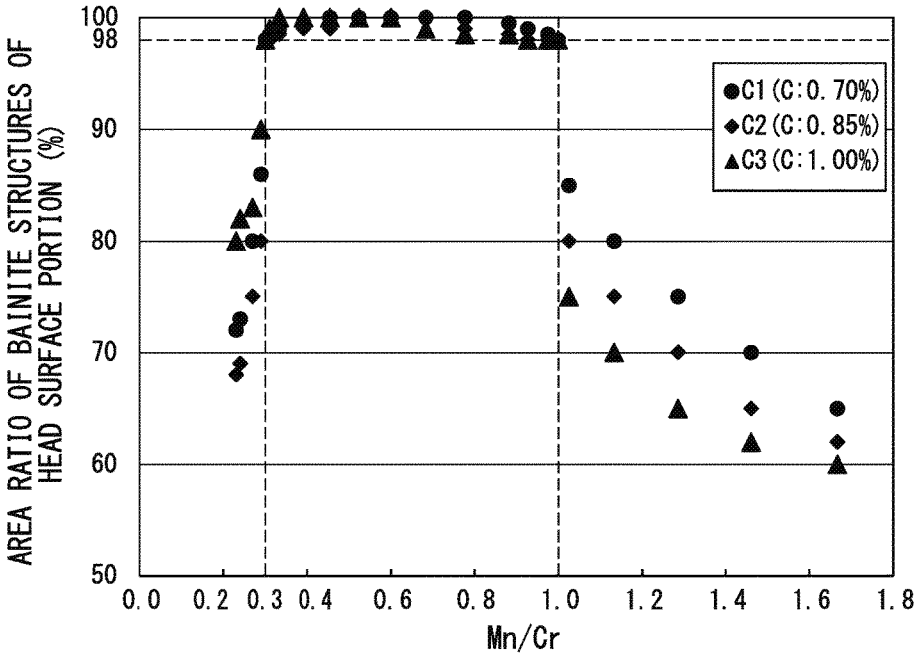
FIG. 5 is a graph showing relationships between value of Mn/Cr and an area ratio of bainite structures of head surface portions of rails in test rails (test steel groups C1 to C3).

Identical to the above-described structure observation method carried out on test steel group A FIG. 5 shows the relationships between a value of Mn/Cr and the area ratio of bainite structures of the head surface portions of the rails in test rails (test steel groups C1 to C3). Meanwhile, "Mn" included in "Mn/Cr" represents Mn content in terms of mass % and "Cr" included therein represents Cr content in terms of mass %. In all test steel groups C1 to C3, it was confirmed that, if the value of Mn/Cr was lower than 0.30, since Cr content was excessive, occurrence of bainite transformation was significantly delayed and martensite structures harmful for wear resistance and surface damage resistance formed. In addition, it was confirmed that, if the value of Mn/Cr was more than 1.00, since Mn content was excessive, pearlite structures harmful for surface damage resistance formed. On the other hand, samples having the value of Mn/Cr within a range of 0.30 to 1.00 had 98% by area or more of bainite structures.

From the above-described results, it became clear that, in order to stably form 98% by area or more of bainite in structures of steel having a chemical components in which C content is high, it is necessary to control the value of Mn/Cr in a predetermined range.

(6. Relationship Between Isothermal Transformation Temperature and Hardness and Relationship Between Isothermal Transformation Temperature and Area Ratio of Bainite)

Furthermore, the present inventors studied heat treatment conditions in order to stably generate bainite structures in structures of steel having chemical components in which C content is high. Material rails in which the carbon content were varied and within a range of 0.70% to 1.00% were produced in a laboratory, test rails (test steel group D) were obtained by accerelated-cooling and isothermal-holding the steel, and a relationship between isothermal-holding temperature and hardness and a relationship between isothermal-holding temperature and structure was studied using the test rails. Meanwhile, the chemical components, and heat treatment conditions of test steel group D are as described below.

<Chemical Components of Test Steel Group D>

C: 0.70% to 1.00%;

Si: 0.50%;

Mn: 0.30% to 1.00%

Cr: 0.50% to 1.30%;

P: 0.0150%;

S: 0.0120%; and a remainder: Fe and impurities

The following heat treatment was carried out on steel having the above-described chemical components, thereby producing the test steel group D (rails).

<Heat Treatment Conditions of Test Steel Group D>

Heating temperature: 950° C. (temperature of austenite transformation completion temperature+30° C. or higher)

Holding time at the above-described heating temperature: 30 min

Cooling conditions: After the above-described holding time elapsed, the rails were cooled to isothermal transformation temperature at a cooling rate of 8° C./sec, then, were held at the isothermal transformation temperature for isothermal-holding time, and were naturally-cooled to room temperature.

Isothermal transformation temperature: 250° C. to 600° C.

Isothermal-holding time (holding time of temperature of steel at isothermal transformation temperature): 800 sec <Structure Observation Method for Test Steel Group D>

Identical to the above-described structure observation method carried out on test steel group A <Hardness Measurement Method for Test Steel Group D>

Figure 6:
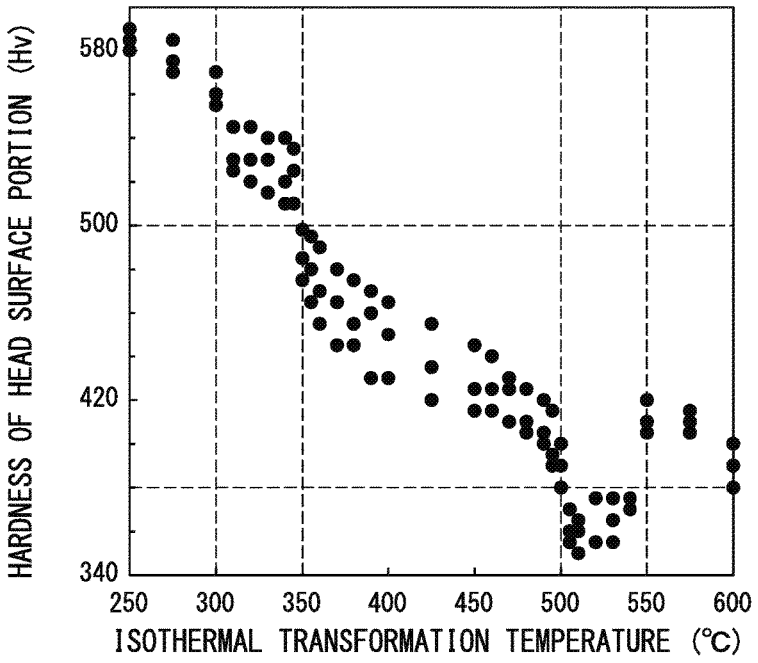
FIG. 6 is a graph showing relationships between an isothermal transformation temperature and hardness of head surface portions of rails in test rails (test steel group D).

Identical to the above-described hardness measurement method for test steel group A FIG. 6 shows the relationships between isothermal transformation temperature and hardness of head surface portions of rails in test rails (test steel group D). As described above, it is necessary for ensuring surface damage resistance to control the hardness of region from head surface of rail to a depth of 10 mm within Hv380 to Hv 500. However, it was found from the graph of FIG. 6 that, if isothermal transformation temperature excesses 500° C., head surface portion having hardness of Hv380 or more, which is necessary for ensuring surface damage resistance, cannot be obtained. This is considered to be because the hardness of the bainite structures decreases, and structures other than bainite, such as pearlite structures, form. In addition, it was confirmed that, if isothermal transformation temperature was lower than 350° C., head surface portion having hardness of Hv500 or less, which is necessary for ensuring surface damage resistance, cannot be obtained. This is considered to be because the hardness of the bainite structures increases, and structures other than bainite, such as martensite structures, form. On the other hand, hardness of head surface portions of test rails in which isothermal transformation temperature was within a range of 350° C. to 500° C. were within a range of Hv380 to Hv500.

Figure 7:
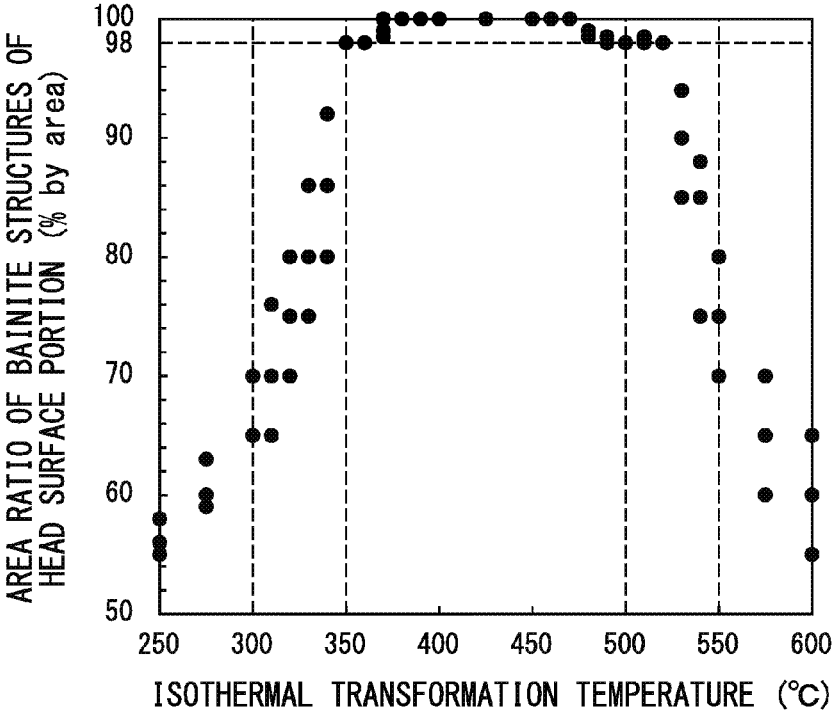
FIG. 7 is a graph showing relationships between an isothermal transformation temperature and an area ratio of bainite structures of head surface portions of rails in test rails (test steel group D).

FIG. 7 shows the relationship between isothermal transformation temperature and area ratio of bainite structures of head surface portions of rails in test rails (test steel group D). It was found from the graph of FIG. 7 that, if isothermal transformation temperature excesses 550° C., since a large amount of pearlite structures form, the area ratio of bainite structures in head surface portions of rails significantly decreases and it becomes difficult to ensure surface damage resistance. In addition, it was found from the graph of FIG. 7 that, if isothermal transformation temperature is more than 500° C. and less than 550° C., head surface portion having 98% or more of area ratio of bainite structures may not be obtained. On the other hand, it was found from the graph of FIG. 7 that, if isothermal transformation temperature is 500° C. or less, 98% or more of area ratio of bainite structures is surely provided in head surface portions of rails to surely enhance surface surface damage generation service life of head surface portions of rails. In addition, it was found from the graph of FIG. 7 that, if isothermal transformation temperature is 300° C. or less, since a large amount of martensite structures form in head surface portions of rails, the area ratio of bainite structures in head surface portions of rails significantly decreases and it become difficult to ensure surface damage resistance. Furthermore, it was found from the graph of FIG. 7 that, if isothermal transformation temperature is more than 300° C. and less than 350° C., it become difficult to ensure head surface portion having 98% or more of area ratio of bainite structures and surface damage generation service life cannot be expected to significantly increase. On the other hand, samples in which isothermal transformation temperature were 350° C. to 500° C. had 98% by area or more of bainite structures.

Accordingly, as shown in FIG. 6 and FIG. 7, the present inventors found that hardness of head surface portion of rail can be controlled within a range of Hv380 to Hv500 and area ratio of bainite structures of head surface portions of rail can be set to 98% or more to significantly enhance surface damage generation service life by controlling isothermal transformation temperature within a range of 350° C. to 550° C.

(7. Relationship Between Isothermal-Holding Time and Area Ratio of Bainite Structures)

Furthermore, the present inventors studied relationship between isothermal-holding time and structure in order to stably generate bainite structures in structures of steel having chemical components in which C content is high. Meanwhile, the chemical components and heat treatment conditions of test tails (test steel group D') used for examination are as described below.

<Chemical components of test steel group D'>

Identical to the above-described chemical components of above-described test steel group D <Heat treatment conditions of test steel group D>

Heating temperature: 950° C. (temperature of austenite transformation completion temperature+30° C. or higher)

Holding time at the above-described heating temperature: 30 min

Cooling conditions: After the above-described holding time elapsed, the rails were cooled to isothermal transformation temperature at a cooling rate of 8° C./sec, then, were held at the isothermal transformation temperature for isothermal-holding time, and were naturally-cooled to room temperature.

Isothermal transformation temperature: 350° C., 400° C., or 550° C.

Isothermal-holding time: 10 sec to 1000 sec

<Structure Observation Method for Test Steel Group D'>

Identical to the above-described structure observation method carried out on test steel group A <Hardness Measurement Method for Test Steel Group D'>

Figure 8:
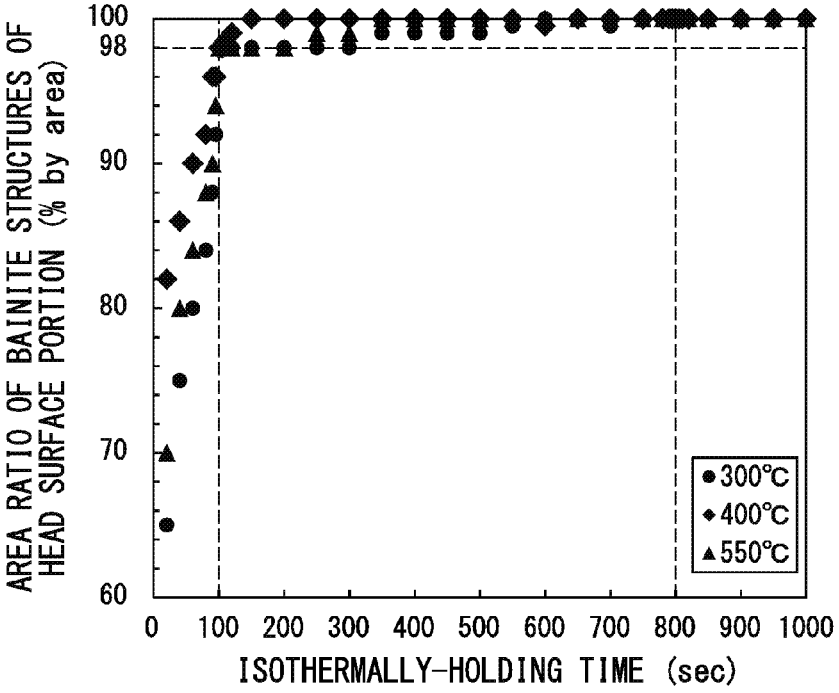
FIG. 8 is a graph showing relationships between isothermally-holding time and an area ratio of bainite structures of head surface portions of rails in test rails (test steel group D').

Identical to the above-described hardness measurement method for test steel group A FIG. 8 shows the relationship between isothermal-holding time and area ratio of bainite structures of head surface portions of rails in test rails (test steel group D'). It was found from the graph of FIG. 8 that, if isothermal-holding time is shorter than 100 sec, the area ratio of bainite structures in head surface portions of rails become lower than 98% and surface damage resistance decrease. This is considered to be because bainite transformation does not completely finish during isothermal-holding and pearlite structures and martensite structures form after isothermal-holding. It was found that, if isothermal-holding time excesses 800 sec, bainite structures are tempered, hardness of bainite structures decreases, and head surface portions having sufficient hardness for securing surface damage resistance cannot be obtained.

A rail according to the present invention obtained by above-described findings is a rail intended to improve the wear resistance and the surface damage resistance as well as significantly enhance service life by controlling the chemical components within a predetermined range, setting structures of a region from head surface of rail head portion to a depth of 10 mm as mainly bainite structures, and, furthermore, controlling the hardness of the region from head surface of rail head portion to a depth of 10 mm.

That is, a rail according to an aspect of the present invention includes a rail head portion having a top head portion which is a flat region extending toward a top portion of the rail head portion in a extending direction of the rail, a side head portion which is a flat region extending toward a side portion of the rail head portion in the extending direction of the rail, and a corner head portion which is a region combining a rounded corner portion extending between the top head portion and the side head portion and an upper half of the side head portion, wherein the rail contains as a chemical components, in terms of mass %, C: 0.70% to 1.00%, Si: 0.20% to 1.50%, Mn: 0.30% to 1.00%, Cr: 0.50% to 1.30%, P: 0.0250% or less, S: 0.0250% or less, Mo: 0% to 0.50%, Co: 0% to 1.00%, Cu: 0% to 1.00%, Ni: 0% to 1.00%, V: 0% to 0.300%, Nb: 0% to 0.0500%, Mg: 0% to 0.0200%, Ca: 0% to 0.0200%, REM: 0% to 0.0500%, B: 0% to 0.0050%, Zr: 0% to 0.0200%, N: 0% to 0.0200%, and a remainder of Fe and impurities, wherein a value of Mn/Cr, which is a ratio of an amount of Mn with respect to an amount of Cr, is within a range of 0.30 to 1.00, wherein structures in a region from a head surface constituted of a surface of the top head portion and a surface of the corner head portion to a depth of 10 mm includes 98% by area or more of bainite structures, and wherein an average hardness of the region from the head surface to a depth of 10 mm is in a range of Hv 380 to Hv 500. The rail according to the aspect of the present invention may contain as the chemical components, in terms of mass %, one or more selected from the group consisting of Mo: 0.01% to 0.50%, Co: 0.01% to 1.00%, Cu: 0.05% to 1.00%, Ni: 0.05% to 1.00%, V: 0.005% to 0.300%, Nb: 0.0010% to 0.0500%, Mg: 0.0005% to 0.0200%, Ca: 0.0005% to 0.0200%, REM: 0.0005% to 0.0500%, B: 0.0001% to 0.0050%, Zr: 0.0001% to 0.0200%, and N: 0.0060% to 0.0200%.

Next, the constitution requirements and the limitation reasons of the rail according to the aspect of the present invention will be described in detail. Meanwhile, in the following description, the units "mass %" for chemical components of steel will be simply denoted as (1) Reasons for Limiting Chemical Components of Steel The reasons for limiting the chemical components of steel constituting the rail of the present embodiment to the above-described numeric ranges will be described in detail.

(C: 0.70% to 1.00%)

C is an effective element for ensuring the wear resistance of bainite structures. When the amount of C is less than 0.70%, as shown in FIG. 1, the favorable wear resistance of the head surface portion of the rail according to the present embodiment cannot be maintained. In addition, when the amount of C is less than 0.70%, hardness decreases and the surface damage resistance of the head surface portion of the rail decreases. On the other hand, when the amount of C exceeds 1.00%, as shown in FIG. 2, the wear resistance of the head surface portion of the rail becomes excessive, the surface damage generation service life is reduced due to the generation of rolling contact fatigue damage, and the surface damage resistance significantly degrades.

Therefore, the amount of C is limited to 0.70% to 1.00%. Meanwhile, in order to stably improve the wear resistance of the head surface portion of the rail, the amount of C is desirably set to 0.72% or more and more desirably set to 0.75% or more. In addition, in order to stably improve the surface damage resistance of the head surface portion of the rail, the amount of C is desirably set to 0.95% or less and more desirably set to 0.85% or less.

(Si: 0.20% to 1.50%)

Si is an element that forms solid solutions in ferrite which is a basic structure of bainite structures, increases the hardness (strength) of the head surface portion of the rail, and improves the surface damage resistance of the head surface portion of the rail. However, when the amount of Si is less than 0.20%, these effects cannot be sufficiently expected. On the other hand, when the amount of Si exceeds 1.50%, a number of surface cracks are generated during hot-rolling. Furthermore, when the amount of Si exceeds 1.50%, hardenability significantly increases, martensite structures are generated in the head surface portion of the rail, and the wear resistance and the surface damage resistance degrades. Therefore, the amount of Si is limited to 0.20% to 1.50%. Meanwhile, in order to stabilize the generation of the bainite structures and improve the wear resistance of the head surface portion of the rail, the amount of Si is desirably set to 0.25% or more and more desirably set to 0.40% or more. In addition, in order to stabilize the generation of bainite structures and improve the surface damage resistance of the head surface portion of the rail, the amount of Si is desirably set to 1.00% or less and is more desirably set to 0.75% or less.

(Mn: 0.30% to 1.00%)

Mn is an element that enhances hardenability, stabilizes bainite transformation, and miniaturizes ferrite, which is base structure of bainite structure, and carbide to ensure hardness of the bainite structure, and further improves the surface damage resistance of the head surface portion of the rail. However, when the amount of Mn is less than 0.30%, the effects are small and thus the surface damage resistance of the head surface portion of the rail does not sufficiently improve. On the other hand, when the amount of Mn exceeds 1.00%, hardenability significantly increases, martensite structures are generated in the head surface portion of the rail, and the surface damage resistance and the wear resistance degrade. Therefore, the amount of Mn is limited to 0.30% to 1.00%. In order to stabilize the generation of the bainite structures and improve wear resistance of the head surface portion of the rail, the amount of Mn is desirably set to 0.35% or more and is more desirably set to 0.40% or more. In order to stabilize the generation of bainite structures and improve the surface damage resistance of the head surface portion of the rail, the amount of Mn is desirably set to 0.90% or less and is more desirably set to 0.80% or less.

(Cr: 0.50% to 1.30%)

Cr is an element that accelerates bainitic transformation, and miniaturizes ferrite as the base structures of bainite structures and carbides to improve the hardness (strength) of bainite structures, thereby improving the surface damage resistance of the head surface portion of the rail. However, when the amount of Cr is less than 0.50%, those effects are weak, as the amount of Cr decreases, the effect of accelerating bainitic transformation and the effect of improving the hardness of bainite structures become more insufficient, and the surface damage resistance of the head surface portion of the rail does not sufficiently improve. On the other hand, in a case in which the amount of Cr exceeds 1.30%, the hardenability significantly increases, martensite structures are generated in the head surface portion of the rail, and the surface damage resistance and the wear resistance degrade. Therefore, the amount of Cr is limited to 0.50% to 1.30%.

In order to stabilize the generation of bainite structures and improve the wear resistance of the head surface portion of the rail, the amount of Cr is desirably set to 0.60% or more and more desirably set to 0.65% or more. In addition, in order to stabilize the generation of bainite structures and improve the surface damage resistance of the head surface portion of the rail, the amount of Cr is desirably set to 1.20% or less and more desirably set to 1.00% or less.

(P: 0.0250% or less)

P is an impurity element included in steel. The amount thereof can be controlled by refining steel in converters. When the amount of P exceeds 0.0250%, the bainite structures become brittle, and the surface damage resistance of the head surface portion of the rail degrades. Therefore, the amount of P is controlled to be 0.0250% or less. The amount of P is desirably controlled to be 0.0200% or less and more desirably controlled to be 0.0140% or less. The lower limit of the amount of P is not limited; however, when dephosphorization capabilities in refining are taken into account, the substantial lower limit of the amount of P is considered to be approximately 0.0020%. Therefore, in the present embodiment, the lower limit value of the amount of P may be set to 0.0020%.

(S: 0.0250% or less)

S is an impurity element included in steel. The amount thereof can be controlled by refining steel in hot-metal ladles. When the amount of S exceeds 0.0250%, inclusions of coarse MnS-based sulfides are likely to be generated, in the head surface portion of the rail, fatigue cracks are generated due to stress concentration generated around the inclusions, and the surface damage resistance degrades. Therefore, the amount of S is controlled to be 0.0250% or less. The amount of S is desirably controlled to be 0.0200% or less and more desirably controlled to be 0.0140% or less. Meanwhile, the lower limit of the amount of S is not limited; however, when desulfurization capabilities in refining are taken into account, the substantial lower limit of the amount of S is considered to be approximately 0.0020%. Therefore, in the present embodiment, the lower limit value of the amount of S may be set to 0.0020%.

Furthermore, in order for improvement in the surface damage resistance by the stabilization of bainite structures in the head surface portion of the rail, improvement in wear resistance by an increase in the hardness (strength) and the like, improvement in toughness, prevention of softening of heat affected zones, and the control of the cross-sectional hardness distribution in the head portion, the chemical components of the rail according to the present embodiment may contain, as necessary, one or more of Mo, Co, Cu, Ni, V, Nb, Mg, Ca, REM, B, Zr, and N. However, the rail according to the present embodiment does not need to contain these elements, and thus the lower limit values of these elements are 0%.

Here, the actions and effects of Mo, Co, Cu, Ni, V, Nb, Mg, Ca, REM, B, Zr, and N in the rail according to the present embodiment will be described.

Mo has effects of accelerating the generation of bainite structures, miniaturizing base ferrite structures of bainite structures and carbides, and improving the hardness of the head surface portion of the rail.

Co has effects of miniaturizing the base ferrite structures on worn surfaces (head surface) and enhancing the wear resistance of the head surface portion of the rail.

Cu has effects of forming solid solutions in base ferrite structures in bainite structures and enhancing the hardness of the head surface portion of the rail.

Ni has effects of improving the toughness and the hardness of bainite structures at the same time and preventing the softening of heat affected zones in weld joints.

V has effects of strengthening bainite structures by precipitation strengthening occurred by carbides, nitrides, and the like generated during hot-rolling and subsequent cooling processes. In addition, V has effects of miniaturizing austenite grains when heat treatments for heating steel to high temperatures are carried out and improving the ductility and the toughness of bainite structures and pearlite structures.

Nb has effects of limiting the generation of pro-eutectoid ferrite structures and pearlite structures which may be generated from prior austenite grain boundaries and stabilizing bainite structures. In addition, Nb has effects of strengthening bainite structures by precipitation strengthening occurred by carbides, nitrides, and the like generated during hot-rolling and subsequent cooling processes. Furthermore, Nb has effects of miniaturizing austenite grains when heat treatments for heating steel to high temperatures are carried out and improving the ductility and the toughness of bainite structures and pearlite structures.

Mg, Ca, and REM have effects of finely dispersing MnS-based sulfides and reducing fatigue damage generated from these MnS-based sulfides.

B has effects of inhibiting the generation of pro-eutectoid ferrite structures and pearlite structures which are generated during bainitic transformation and stably generating 98% by area or more of bainite structures in the head surface portion of the rail.

Zr has effects of limiting the formation of segregation bands in central parts of bloom or slab and limiting the generation of martensite structures by increasing the equiaxed crystal ratios of solidification structures.

N has effects of accelerating the generation of nitrides of V and improving the hardness of the head surface portion of the rail.

(Mo: 0% to 0.50%)

Similar to Mn or Cr, Mo is an element capable of increasing strength and stably generating 98% by area or more of bainite structures in the head surface portion of the rail. In order to obtain these effects, the amount of Mo may be set to 0.01% or more. On the other hand, in a case in which the amount of Mo exceeds 0.50%, due to an excessive increase in hardenability, martensite structures are generated, and the wear resistance degrades. Furthermore, rolling contact fatigue damage is generated in the head surface portion of the rail, and there are concerns that surface damage resistance may degrade. Furthermore, in a case in which the amount of Mo exceeds 0.50%, there are concerns that segregation may be promoted in steel ingots and martensite structures which are harmful to toughness may be generated in segregated portions. Therefore, the amount of Mo is desirably set to 0.50% or less. The lower limit value of the amount of Mo may be set to 0.02% or 0.03%. In addition, the upper limit value of the amount of Mo may be set to 0.45% or 0.40%.

(Co: 0% to 1.00%)

Co is an element that forms solid solutions in ferrite of bainite structures, miniaturizes the base structures (ferrite) on worn surfaces, increases the hardness of the worn surfaces, and improves the wear resistance of the head surface portion of the rail. In order to obtain these effects, the amount of Co may be set to 0.01% or more. On the other hand, when the amount of Co exceeds 1.00%, the above-described effects are saturated, and structures cannot be miniaturized in accordance with the amount thereof. In addition, when the amount of Co exceeds 1.00%, an increase in raw material costs is caused, and economic efficiency degrades. Therefore, the amount of Co is desirably set to 1.00% or less. The lower limit value of the amount of Co may be set to 0.02% or 0.03%. In addition, the upper limit value of the amount of Co may be set to 0.95% or 0.90%.

(Cu: 0% to 1.00%)

Cu is an element that forms solid solutions in the base ferrite of bainite structures and improves the strength of the head surface portion of the rail by solid solution strengthening. In order to obtain these effects, the amount of Cu may be set to 0.05% or more. On the other hand, when the amount of Cu exceeds 1.00%, due to excessive improvement in hardenability, there are concerns that martensite structures which are harmful to the wear resistance and the surface damage resistance of the head surface portion of the rail are likely to be generated. Therefore, the amount of Cu is desirably set to 1.00% or less. The lower limit value of the amount of Cu may be set to 0.07% or 0.10%. In addition, the upper limit value of the amount of Cu may be set to 0.95% or 0.90%.

(Ni: 0% to 1.00%)

Ni is an element that stabilizes austenite and also has effects of lowering bainitic transformation temperatures, miniaturizing bainite structures, and improving the toughness of the head surface portion of the rail. In order to obtain these effects, the amount of Ni may be set to 0.05% or more. On the other hand, when the amount of Ni exceeds 1.00%, the transformation rates of bainite structures significantly decrease, and there are concerns that martensite structures which are harmful to the wear resistance and the surface damage resistance of the head surface portion of the rail are likely to be generated. Therefore, the amount of Ni is desirably set to 1.00% or less. The lower limit value of the amount of Ni may be set to 0.07% or 0.10%. In addition, the upper limit value of the amount of Ni may be set to 0.95% or 0.90%.

(V: 0% to 0.300%)

V is an effective component for increasing the strength of the head surface portion of the rail by means of precipitation hardening occurred by V carbides and V nitrides generated in cooling processes during hot-rolling. Furthermore, V has an action of limiting the growth of crystal grains when heat treatments for heating steel to high temperatures are carried out and is thus an effective component for miniaturizing austenite grains and improving the ductility and the toughness of the head surface portion of the rail. In order to obtain these effects, the amount of V may be set to 0.005% or more. On the other hand, when the amount of V exceeds 0.300%, the above-described effects are saturated, and thus the amount of V is desirably set to 0.300% or less. The lower limit value of the amount of V may be set to 0.007% or 0.010%. In addition, the upper limit value of the amount of V may be set to 0.250% or 0.200%.

(Nb: 0% to 0.0500%)

Nb is an element that limits the generation of proeutectoid ferrite structures and pearlite structures which are, in some cases, generated from prior austenite grain boundaries and stably generates bainite structures by means of an increase in hardenability. In addition, Nb is an effective component for increasing the strength of the head surface portion of the rail by means of precipitation hardening occurred by Nb carbides and Nb nitrides generated in cooling processes during hot-rolling. Furthermore, Nb has an action of limiting the growth of crystal grains when heat treatments for heating steel to high temperatures are carried out and is thus an effective component for miniaturizing austenite grains and improving the ductility and the toughness of the head surface portion of the rail. In order to obtain these effects, the amount of Nb may be set to 0.0010% or more. On the other hand, when the amount of Nb exceeds 0.0500%, intermetallic compounds and coarse precipitates of Nb (Nb carbides) are generated, and there are concerns that the toughness of the head surface portion of the rail may degrade, and thus the amount of Nb is desirably set to 0.0500% or less. The lower limit value of the amount of Nb may be set to 0.0015% or 0.0020%. In addition, the upper limit value of the amount of Nb may be set to 0.0450% or 0.0400%.

(Mg: 0% to 0.0200%)

Mg bonds with S so as to form fine sulfides (MgS), and this MgS finely disperses MnS, mitigates stress concentration generated around MnS, and improves the fatigue damage resistance of the head surface portion of the rail. In order to obtain these effects, the amount of Mg may be set to 0.0005% or more. On the other hand, when the amount of Mg exceeds 0.0200%, coarse oxides of Mg are generated, fatigue cracks are generated due to stress concentration generated around these coarse oxides, and there are concerns that the fatigue damage resistance of the head surface portion of the rail may degrade. Therefore, the amount of Mg is desirably set to 0.0200% or less. The lower limit value of the amount of Mg may be set to 0.0008% or 0.0010%. In addition, the upper limit value of the amount of Mg may be set to 0.0180% or 0.0150%.

(Ca: 0% to 0.0200%)

Ca is an element that has a strong bonding force with S and forms sulfides (CaS). This CaS finely disperses MnS, mitigates stress concentration generated around MnS, and improves the fatigue damage resistance of the head surface portion of the rail. In order to obtain these effects, the amount of Ca may be set to 0.0005% or more. On the other hand, when the amount of Ca exceeds 0.0200%, coarse oxides of Ca are generated, fatigue cracks are generated due to stress concentration generated around these coarse oxides, and there are concerns that the fatigue damage resistance of the head surface portion of the rail may degrade. Therefore, the amount of Ca is desirably set to 0.0200% or less. The lower limit value of the amount of Ca may be set to 0.0008% or 0.0010%. In addition, the upper limit value of the amount of Ca may be set to 0.0180% or 0.0150%.

(REM: 0% to 0.0500%)

REM are elements having a deoxidizing and desulfurizing effect and generates oxysulfide ($REM_2O_2S$). $REM_2O_2S$ serves as generation nuclei of Mn sulfide-based inclusions. $REM_2O_2S$ has a high melting point and thus is not melted during hot-rolling and prevents Mn sulfide-based inclusions from stretching due to hot-rolling. As a result, $REM_2O_2S$ finely disperses MnS and mitigates stress concentration generated around MnS, whereby the fatigue damage resistance of the head surface portion of the rail can be improved. In order to obtain these effects, the amount of REM may be set to 0.0005% or more. On the other hand, when the amount of REM exceeds 0.0500%, full hard $REM_2O_2S$ is excessively generated, fatigue cracks are generated due to stress concentration generated around $REM_2O_2S$, and there are concerns that the fatigue damage resistance of the head surface portion of the rail may degrade. Therefore, the amount of REM is desirably set to 0.0500% or less. The lower limit value of the amount of REM may be set to 0.0008% or 0.0010%. In addition, the upper limit value of the amount of REM may be set to 0.0450% or 0.0400%.

Meanwhile, REM represents rare earth metals such as Ce, La, Pr, and Nd. "The amount of REM" refers to the total value of the amounts of all of these rare earth metals. When the total of the amounts of rare earth metals is within the above-described range, the same effects can be obtained regardless of the kinds of rare earth metal.

(B: 0% to 0.0050%)

B is an element that limits the generation of pro-eutectoid ferrite structures and pearlite structures which are, in some cases, generated from prior austenite grain boundaries, stably generates bainite structures. In order to obtain these effects, the amount of B may be set to 0.0001% or more. On the other hand, when the amount of B exceeds 0.0050%, these effects are saturated, and raw material costs are unnecessarily increased, and thus the amount of B is desirably set to 0.0050% or less. The lower limit value of the amount of B may be set to 0.0003% or 0.0005%. In addition, the upper limit value of the amount of B may be set to 0.0045% or 0.0040%.

(Zr: 0% to 0.0200%)

Zr generates $ZrO_2$-based inclusions. These $ZrO_2$-based inclusions have favorable lattice matching properties with γ-Fe and are thus an element that serves as a solidification nuclei of high-carbon rail steel in which γ-Fe is a solidified primary phase and increases the equiaxed crystal ratios of solidification structures, thereby limiting the formation of segregation bands in bloom or slab central parts and limiting the generation of martensite structures in rail segregation portions. In order to obtain these effects, the amount of Zr may be set to 0.0001% or more. On the other hand, when the amount of Zr exceeds 0.0200%, a large amount of coarse Zr-based inclusions are generated, fatigue cracks are generated due to stress concentration generated around these coarse Zr-based inclusions, and there are concerns that the surface damage resistance may degrade. Therefore, the amount of Zr is desirably set to 0.0200% or less. The lower limit value of the amount of Zr may be set to 0.0003% or 0.0005%. In addition, the upper limit value of the amount of Zr may be set to 0.0180% or 0.0150%.

(N: 0% to 0.0200%)

N is an element that, in the case of being included together with V, generates nitrides of V in cooling processes after hot-rolling, increases the hardness (strength) of bainite structures, and improves the wear resistance and the surface damage resistance of the head surface portion of the rail. In order to obtain these effects, the amount of N may be set to 0.0060% or more. On the other hand, when the amount of N exceeds 0.0200%, it becomes difficult to form solid solutions in steel, air bubbles which serves as starting points of fatigue damage are generated, and internal fatigue damage is likely to be generated. Therefore, the amount of N is desirably set to 0.0200% or less. The lower limit value of the amount of N may be set to 0.0065% or 0.0070%. In addition, the upper limit value of the amount of N may be set to 0.0180% or 0.0150%.

The amounts of the alloy elements included in the chemical components of the rail according to the present embodiment are as described above, and the remainder of the chemical components is Fe and impurities. Impurities are incorporated into steel depending on the status of raw materials, materials, production facilities, and the like, and the incorporation of impurities is permitted as long as the characteristics of the rail according to the present embodiment are not impaired.

Rails having the above-described chemical components are obtained by carrying out melting in ordinarily-used melting furnaces such as converters or electric furnaces, casting molten steel obtained by the above-described melting using an ingot-making and blooming method or a continuous casting method, then, hot-rolling bloom or slab obtained by the above-described casting in rail shapes, and furthermore, carrying out heat treatments in order to control the metallographic structures and the hardness of the head surface portion of the rail.

(2) Reasons for Limiting Value of Mn/Cr

Next, the reasons for limiting value of Mn/Cr (see below expression 1), which is a ratio of Mn content (Mn) with respect to Cr content (Cr), within a range of 0.30 to 1.00 will be described in detail.

Mn/Cr: Expression 1

As shown in FIG. 5, if value of Mn/Cr is less than 0.30, Cr content with respect to Mn content is excessive, time required for completing bainitic transformation significantly delays, and martensite structures harmful for surface damage resistance and wear resistance generate, thereby it becomes difficult to ensure surface damage resistance and wear resistance of the head surface portion of the rail. In addition, if the value of Mn/Cr is more than 1.00, Mn content with respect to Cr content is excessive, a large amount of pearlite structures harmful for surface damage resistance generate, and it becomes difficult to ensure surface damage resistance of the head surface portion of the rail. Therefore, the value of Mn/Cr is limited within a range of 0.30 to 1.00. In order to further suppress generation of martensite structures and sufficiently ensure the surface damage resistance and wear resistance, the value of Mn/Cr is preferably 0.38 or more and more preferably 0.50 or more. Furthermore, in order to further suppress generation of pearlite structures and sufficiently ensure the surface damage resistance and wear resistance of the head surface portion of the rail, the value of Mn/Cr is preferably 0.93 or less and more preferably 0.90 or less.

Meanwhile, Mn is known as an austenite stabilization element which can keep austenite in low temperature and Cr is known as an element increasing sensitivity of hardenability, and it is known that transformation from austenite structures to pearlite structures can be controlled by adjusting Mn content and Cr content.

On the other hand, in the rail according to the present embodiment, it is important to control transformation from austenite structures to bainite structures by controlling Mn content and Cr content. Unlike in pearlitic transformation, it is essential for obtaining the bainitic transformation to hold temperature after accerelated-cooling in method for producing. The present inventors found that transformation can be controlled so that bainite structures form from austenite structures as well as generation of martensite structures and pearlite structures can be suppressed during isothermal-holding by limiting the value of Mn/Cr within the above-described range.

(3) Reasons for Limiting Necessary Ranges of Metallographic Structures and Bainite Structures.

(Structures in a Region from a Head Surface to a Depth of 10 mm: 98% by Area or More of Bainite Structures)

Next, the reasons for forming the bainite structures in the region from the head surface of the rail to a depth of 10 mm (i.e. head surface portion of the rail) will be described. At first, the reason for limiting the structures as bainite structures will be described.

In the head surface portion of the rail which contacts with wheel, it is most important to ensure surface damage resistance and wear resistance. Relationship between metallographic structures and surface damage resistance and relationship between metallographic structures and wear resistance were studied, and thereby, it was confirmed as shown in FIG. 1 and FIG. 2 that the best way for enhancing both of surface damage resistance and wear resistance is to form 98% by area or more of bainite structures having relatively high carbon content in the head surface portion. Therefore, in the present embodiment, in order to improve both of surface damage resistance and wear resistance of the head surface portion of the rail, the metallographic structures of the head surface portion of the rail are limited as 98% by area or more of bainite structures.

Next, the reason for limiting a region in which the bainite structures are generated to "a region from head surface to a depth of 10 mm" will be described.

In a case in which, only in regions from the head surface to a depth of less than 10 mm, the structures are controlled as described above, it is not possible to ensure surface damage resistance and wear resistance which are required in the head surface portion of the rail, and sufficient improvement in the rail service life becomes difficult. In order to further improve surface damage resistance and wear resistance of the head surface portion of the rail, it is desirable to form 98% by area or more of the bainite structures in region from the head surface to a depth of approximately 30 mm.

Figure 9:
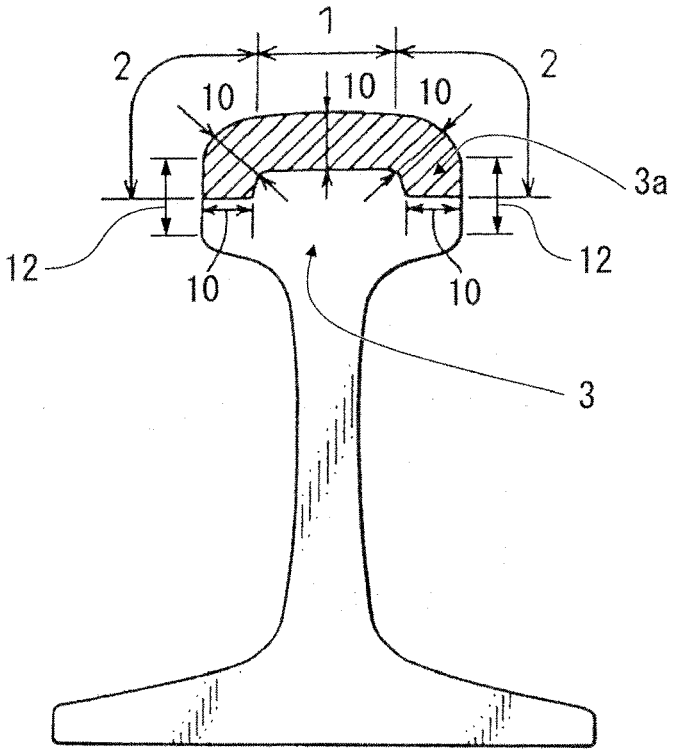
FIG. 9 is a schematic cross sectional view of a rail according to a first embodiment of the present invention.

FIG. 9 shows the constitution of the rail according to the present embodiment and a region requiring 98% by area or more of the bainite structures. A rail head portion 3 includes a top head portion 1, a corner head portions 2 located on both ends of the top head portion 1, and a side head portion 12. The top head portion 1 is an approximately flat region extending toward the top portion of the rail head portion in the rail extending direction. The side head portion 12 is an approximately flat region extending toward the side portion of the rail head portion in the rail extending direction. The corner head portion 2 is a region combining a rounded corner portion extending between the top head portion 1 and the side head portion 12 and the upper half (the upper side of the half portion of the side head portion 12 in the vertical direction) of the side head portion 12. One of the two corner head portions 2 is a gauge corner (G.C.) portion that mainly comes into contact with wheels.

A region combining the surface of the top head portion 1 and the surface of the corner head portion 2 will be termed as the head surface of the rail. This region is a region in the rail which most frequently comes into contact with wheels. A region from the surfaces of the corner head portions 2 and the top head portion 1 (the head surface) to a depth of 10 mm will be termed as a head surface portion 3*a* (the shadow portion in FIG. 9).

As shown in FIG. 9, when the bainite structures having a predetermined area ratio and predetermined hardness are disposed in the head surface portion 3*a* which is the region from the surface of the corner head portions 2 and the top head portion 1 to a depth of 10 mm, the surface damage resistance and the wear resistance of the head surface portion 3*a* of the rail sufficiently improve. Therefore, it is necessary that 98% by area or more of the bainite structures are disposed in the head surface portion 3*a*, in which surface damage resistance and wear resistance are required since the head surface portion 3*a* is a place at which wheels and the rail come into contact with each other. Meanwhile, the structures of portions not requiring the above-described characteristics other than the head surface portion 3*a* are not particularly defined.

In a case in which, only in regions from the head surface to a depth of less than 10 mm, the structures are controlled as described above, it is not possible to ensure surface damage resistance and wear resistance which are required in the head surface portion of the rail, and sufficient improvement in the rail service life becomes difficult. Meanwhile, ranges to which 98% by area or more of the bainite structures is added may be regions from the head surface to a depth of more than 10 mm. In order to further improve surface damage resistance and wear resistance, it is desirable to form 98% by area or more of the bainite structures in regions from the head surface to a depth of approximately 30 mm.

The metallographic structures of the head surface portion of the rail according to the present embodiment preferably include 98% by area or more of the bainite structures. However, the metallographic structures of the head surface portion of the rail may include less than 2% by area of structures other than bainite structures. Examples of the structures other than bainite structures are pearlite structures, pro-eutectoid ferrite structures, pro-eutectoid cementite structures, martensite structures, and the like. It is preferable that no structure other than bainite structures is included in the head surface portion of the rail. However, if the structures are included in the head surface portion of the rail, there are no significant adverse effects on the wear resistance and the surface damage resistance of the head surface portion of the rail as long as the amount of the structures are less than 2% by area. Therefore, the structures of the head surface portion of the rail according to the present embodiment having excellent surface damage resistance and excellent wear resistance may include less than 2% by area of a slight amount of pearlite structures, pro-eutectoid ferrite structures, pro-eutectoid cementite structures, and martensite structures. In other words, the metallographic structure of the head surface portion of the rail according to the present embodiment includes 98% or more of the bainite structures in terms of the area ratio and, in a case in which above-described structures other than bainite structures are included, the total area ratio of the structures is limited to 2% by area or less. Meanwhile, pro-eutectoid ferrite is differentiated from ferrite which is the base structures of pearlite structures and bainite structures.

In addition, in order to sufficiently enhance the wear resistance and the surface damage resistance of the head surface portion of the rail, the head surface portion preferably includes 99% by area or more of bainite structures.

The area ratio of bainite at locations of an arbitrary depth from the head surface are obtained by, for example, observing the metallographic structures of the locations of the arbitrary depth in visual fields of optical microscopes with a magnification of 200 times. In addition, it is preferable that the above-described observation using optical microscopes is carried out 20 visual fields (20 places) or more at the locations of the arbitrary depth, and the average value of the area ratios of bainite structures at the respective visual fields are considered to be the area ratio of bainite structures included in the locations of the arbitrary depth.

When the area ratios of the bainite structures are 98% or higher in both a location of a depth of approximately 2 mm from the head surface and a location of a depth of approximately 10 mm from the head surface, it is possible to consider that 98% or more of the metallographic structures in regions from the head surface to a depth of at least 10 mm (the head surface portion of the rail) are bainite structures. In addition, it is possible to consider the average value of the area ratio of the bainite structures at a location of a depth of 2 mm from the head surface and the area ratio of the bainite structures at a location of a depth of 10 mm from the head surface as the area ratio of the average bainite structures of the entire region from the head surface to a depth of 10 mm.

Meanwhile, the area ratios of structures other than bainite structures (that is, pearlite structures, pro-eutectoid ferrite structures, pro-eutectoid cementite structures, martensite structures, and the like) can be measured in the same manner as for the above-described area ratios of bainite structures.

When the area ratios of structures other than bainite structures are less than 2% in both a location of a depth of approximately 2 mm from the head surface and a location of a depth of approximately 10 mm from the head surface, it is possible to consider that the area ratios of structures other than bainite structures in the structures of regions from the head surface to a depth of at least 10 mm is less than 2%.

(4) Reasons for Limiting Hardness of Head Surface Portion of Rail (Average Hardness of Ranges of Region from Head Surface to Depth of 10 mm: Hv 380 to Hv 500)

Next, the reasons for limiting the average hardness of a region from the head surface to a depth of 10 mm to a range of Hv 380 to Hv 500 will be described.

When the hardness of a region from the head surface to a depth of 10 mm (the head surface portion of the rail) is less than Hv 380, as shown in FIG. 4, plastic deformation develops on rolling contact surfaces, the generation of rolling contact fatigue damage attributed to the plastic deformation reduces surface damage generation service life, and the surface damage resistance of the head surface portion of the rail significantly degrades. In addition, when the hardness of the head surface portion of the rail exceeds Hv 500, as shown in FIG. 4, the wear acceleration effect of the head surface portion of the rail is reduced, the generation of rolling contact fatigue damage in the head surface portion of the rail reduces surface damage generation service life, and the surface damage resistance significantly degrades. Therefore, the hardness of the head surface portion of the rail is limited to a range of Hv 380 to Hv 500.

Meanwhile, in order to further limit the development of plastic deformation on rolling contact surfaces and sufficiently ensure surface damage resistance, the hardness of the region from the head surface to a depth of 10 mm is desirably set to Hv 385 or more and more desirably set to Hv 390 or more. In addition, in order to limit the reduction of the wear acceleration effect and sufficiently ensure surface damage resistance by further limiting the generation of rolling contact fatigue damage, the hardness of the region from the head surface to a depth of 10 mm is desirably set to Hv 485 or less and more desirably set to Hv 470 or less.

In a case in which the hardness is not controlled as described above only in regions from the head surface to a depth of less than 10 mm, sufficient improvement in rail characteristics becomes difficult. Meanwhile, regions having hardness of Hv 380 to Hv 500 may extend a depth of more than 10 mm from the head surface. The hardness of regions from the head surface to a depth of approximately 30 mm is desirably set to Hv 380 to Hv 500. In this case, the surface damage resistance and the surface damage generation service life of the rail further improve.

Meanwhile, the hardness of the head surface portion of the rail is preferably obtained by averaging hardness measurement values at a plurality of places in the head surface portion. In addition, when both the average hardness at 20 places of a depth of approximately 2 mm from the head surface and the average hardness at 20 places of a depth of approximately 10 mm from the head surface are Hv 380 to Hv 500, the hardness of the region from the head surface to a depth of at least 10 mm is assumed to be Hv 380 to Hv 500. An example of a hardness measurement method will be described below.

<Example of Method and Conditions for Measuring Hardness of Head Surface Portion of Rail>

Device: Vickers hardness tester (the load was 98 N)

Sampling method for test specimens for measurement: Samples including the head surface portion are cut out from a transverse cross section of the rail head portion.

Pretreatment: The transverse section is polished using diamond abrasive grains having an average grain size of 1 μm.

Measurement method: Measured according to JIS Z 2244.

Calculation of the average hardness at locations of a depth of 2 mm from the head surface: Hardness is measured at arbitrary 20 points of a depth of 2 mm from the head surface, and the average value of measurement values is calculated.

Calculation of the average hardness at locations of a depth of 10 mm from the head surface: Hardness is measured at arbitrary 20 points of a depth of 10 mm from the head surface, and the average value of measurement values is calculated.

Calculation of the average hardness of the head surface portion: The average value of the average hardness at locations of a depth of 2 mm from the head surface and the average hardness at locations of a depth of 10 mm from the head surface is calculated.

Meanwhile, in the present embodiment, the "transverse section" refers to a cross section perpendicular to the rail longitudinal direction.

(5) Heat Treatment Conditions for Head Surface

Next, a production method for the above-described rail having excellent wear resistance and surface damage resistance according to the present embodiment will be described.

Figure 13:
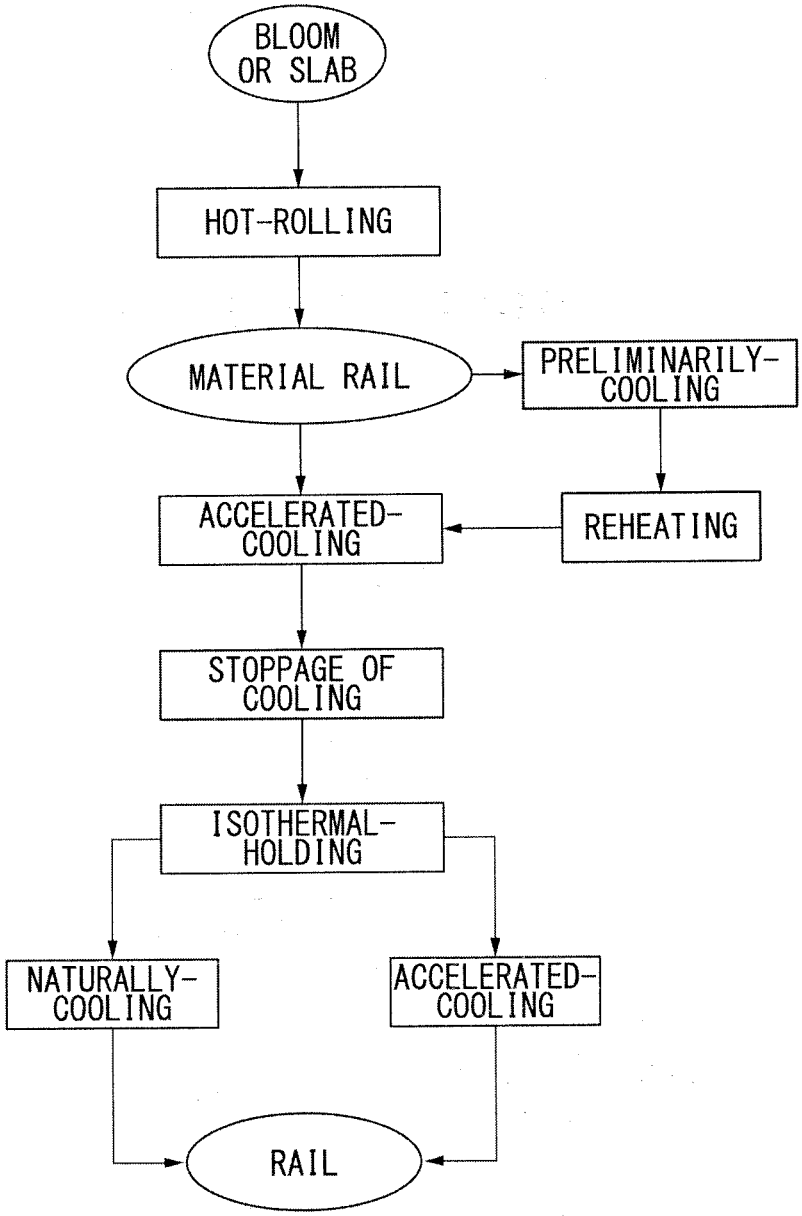
FIG. 13 is a flowchart showing a production method for a rail according to another embodiment of the present invention.

As shown in FIG. 13, a production method for a rail according to the present embodiment includes hot-rolling a bloom or a slab containing chemical components of steel constructing the above-described rail according to the present embodiment in a rail shape to obtain a material rail, accelerated-cooling the head surface of the material rail from a temperature region of 700° C. or higher which is a temperature region that is equal to or higher than a transformation start temperature from austenite to a temperature region of 350° C. to 500° C. at a cooling rate of 3.0° C./sec to 20.0° C./sec after the hot-rolling, holding a temperature of the head surface of the material rail in the temperature region of 350° C. to 500° C. for 100 sec to 800 sec after the accelerated-cooling, and naturally-cooling or further accelerated-cooling the material rail to room temperature after the holding. The production method for a rail according to the present embodiment may further include preliminarily-cooling the hot-rolled rail and then reheating the head surface of the material rail to an austenite transformation completion temperature+30° C. or higher between the hot-rolling and the accelerated-cooling.

The material rail refers to a bloom or a slab after hot-rolling in a rail shape and before finishing a heat treatment for microstructure control. Therefore, the material rail has a structure other than that of the rail according to the present embodiment, but has the same shape as that of the rail according to the present embodiment. That is, the material rail includes a material rail head portion having a top head portion which is a flat region extending toward the top portion of the material rail head portion in a extending direction of the material rail, a side head portion which is a flat region extending toward a side portion of the material rail head portion in the extending direction of the material rail, and a corner head portion which is a region combining a rounded corner portion extending between the top head portion and the side head portion and the upper half of the side head portion, and has a head surface constituted of the surface of the top head portion and the surface of the corner head portion. In the production method for a rail according to the present embodiment, in order to control the structure of the head surface portion of the rail, the temperature of the head surface of the material rail is controlled. The structures of places other than the head surface portion in the rail according to the present embodiment are not particularly limited, and thus, in the production method for a rail according to the present embodiment, it is not necessary to control places other than the head surface of the material rail as described above. The temperature of the head surface of the material rail can be measured using, for example, a radiation-type thermometer.

The transformation start temperature from austenite refers to a temperature at which, when steel in which almost all of the structures are austenite is cooled, austenite begins to transform to structures other than austenite. For example, the transformation start temperature from austenite of hypo-eutectoid steel is an $Ar_3$ point (a temperature at which transformation from austenite to ferrite begins), the transformation start temperature from austenite of hyper-eutectoid steel is an $Ar_{cm}$ point (a temperature at which transformation from austenite to cementite begins), and the transformation start temperature from austenite of eutectoid steel is an $Ar_1$ point (a temperature at which transformation from austenite to ferrite and cementite begins). The transformation start temperature from austenite is influenced by the chemical components of steel, particularly, the amount of C in steel.

The austenite transformation completion temperature refers to a temperature at which almost all of the structures of steel become austenite during the heating of the steel as described above. For example, the austenite transformation completion temperature of hypo-eutectoid steel is the $Ac_3$ point, the austenite transformation completion temperature of hyper-eutectoid steel is the $Ac_{cm}$ point, and the austenite transformation completion temperature of eutectoid steel is the $Ac_1$ point.

Hereinafter, the reasons for limiting the conditions of the respective heat treatments after hot-rolling will be described.

<1> Cooling Start Temperature

The production method for a rail according to the present embodiment includes hot-rolling bloom or slab in a rail shape in order to obtain material rails and accelerated-cooling the material rails which is carried out for micro-structure control. The conditions for the hot-rolling are not particularly limited and may be appropriately selected from well-known hot-rolling conditions for rails as long as there are no obstacles to carrying out the subsequent steps. The hot-rolling and the accelerated-cooling are preferably continuously carried out; however, depending on the limitation of production facilities and the like, it is also possible to cool and then reheat the head surface of the hot-rolled material rail before the accelerated-cooling.

The temperature of the head surface of the material rail when the heat treatment (accelerated-cooling) begins needs to be equal to or higher than the transformation start temperature from austenite. In a case in which the temperature of the head surface of the material rail when the heat treatment begins is lower than the transformation start temperature from austenite, there are cases in which required structures of the head surface portion of the rail cannot be obtained. This is because structures other than austenite are generated in the head surface portion of the material rail before the start of the accelerated-cooling and these structures remain after the heat treatment.

Meanwhile, the transformation start temperature from austenite significantly varies depending on the amount of carbon in steel as described above. The lower limit of the transformation start temperature from austenite of steel having the chemical components of the rail according to the present embodiment is 700° C. Therefore, in the production method for a rail according to the present embodiment, it is necessary to set the lower limit value of the accelerated-cooling start temperature in the accelerated-cooling to 700° C. or higher.

In a case in which cooling (hereinafter, in some cases, referred to as preliminary cooling) and reheating are carried out between hot-rolling and accelerated-cooling, the conditions for the preliminary cooling of the head surface of the material rail are not limited, but the material rail is preferably preliminarily cooled to room temperature in order to facilitate transportation of rails. In addition, in this case, the head surface of the material rail needs to be reheated until the temperature of the head surface of the material rail reaches the austenite transformation completion temperature+30° C. or higher. In a case in which the temperature of the head surface of the material rail is lower than the austenite transformation completion temperature+30° C. when the reheating ends, there are cases in which required structures of the head surface portion of the rail cannot be obtained. This is because structures other than austenite remain in the head surface portion of the material rail when the reheating ends and these structures remain after the reheating.

Meanwhile, in order to limit austenite grains being coarsened (that is, the coarsening of pearlite structures after transformation) during the reheating, it is desirable that the reheating temperature is set to the austenite transformation completion temperature+30° C. or higher and the maximum reheating temperature is controlled to be 1,000° C. or lower.

The head surface of the material rail after the hot-rolling or after the reheating is acceleratively-cooled from a temperature region of 700° C. or higher at a cooling rate of 3.0° C./sec to 20.0° C./sec. When the temperature of the head surface of the material rail is lower than 700° C. when the accelerated-cooling begins, since bainite structures are generated in the head surface portion of the material rail before the accelerated-cooling as described above, it becomes impossible to control hardness of the head surface portion with heat treatment and the predetermined hardness cannot be obtained. In addition, when the temperature of the head surface of the material rail is lower than 700° C. when the accelerated-cooling begins and the carbon content of steel is high, since pearlite structures are generated in the head surface portion, the surface damage resistance of the rail degrades. Therefore, the temperature of the head surface of the material rail when the accelerated-cooling begins is limited to 700° C. or higher.

The accelerated-cooling start temperature of the head surface of the material rail is desirably 720° C. or higher in order to stabilize the heat treatment effects. In addition, in order to improve the hardness and the structures of the inside (region of a depth of more than 10 mm from the head surface) of the rail head portion, the accelerated-cooling start temperature of the head surface of the material rail is more desirably set to 750° C. or higher.

In a case in which the accelerated-cooling begins without carrying out cooling and reheating after the hot-rolling, the upper limit of the accelerated-cooling start temperature of the head surface of the material rail is not particularly limited. In a case in which the accelerated-cooling begins without carrying out cooling and reheating after the hot-rolling, the temperature of the head surface of the material rail when finish rolling ends often reaches approximately 950° C., and thus the substantial upper limit value of the accelerated-cooling start temperature reaches approximately 900° C. In order to shorten the heat treatment time, the accelerated-cooling start temperature is desirably set to 850° C. or lower.

On the other hand, in a case in which the head surface of the hot-rolled material rail is cooled and reheated, in order to shorten the heat treatment time, the accelerated-cooling start temperature of the head surface of the material rail is desirably controlled to 850° C. or lower.

The transformation start temperature from austenite and the austenite transformation completion temperature vary depending on the amount of carbon and the chemical components of steel. In order to accurately obtain the transformation start temperature from austenite and the austenite transformation completion temperature, verification by means of tests is required. However, the transformation start temperature from austenite and the austenite transformation completion temperature may be assumed on the basis of only the amount of carbon in steel from the Fe—$Fe_3C$-based equilibrium diagram described in metallurgy textbooks (for example, "Iron and Steel Materials", The Japan Institute of Metals and Materials). The transformation start temperature from austenite of the rail according to the present embodiment is generally in a range of 700° C. to 800° C.

<2> Accelerated-Cooling Rates

Next, the reasons for limiting the cooling rate in the accelerated-cooling of the head surface of the material rail to 3.0° C./sec to 20.0° C./sec will be described.

When the head surface of the material rail is accelerative-ly-cooled at a cooling rate of slower than 3.0° C./sec, since pearlite structures are generated in the head surface portion of the rail, rolling contact fatigue damage is easily generated, and the surface damage resistance degrades. In addition, when the head surface of the material rail is acceleratively-cooled at a rate of faster than 20.0° C./sec, the heat recovery amount after the accelerated-cooling increases, and it becomes difficult to perform temperature holding after the accelerated-cooling which will be detailed later. As a result, the bainitic transformation temperature increases, the control of the hardness of the head surface portion of the rail becomes difficult, the hardness of the head surface portion of the rail decreases, and the surface damage resistance degrades. Therefore, the cooling rate is limited to a range of 3.0° C./sec to 20.0° C./sec.

In the production method for a rail according to the present embodiment, the "cooling rate" refers to a value obtained by dividing the difference between the cooling start temperature and the cooling end temperature by the cooling time.

<3> Stoppage Temperature Range of Accelerated-Cooling

The reasons for limiting the accelerated-cooling stoppage temperature in the above-described accelerated-cooling the head surface of the material rail to a range of 350° C. to 500° C. will be described.

When the accelerated-cooling is stopped in a state in which temperature of the head surface of the material rail excesses 500° C., the bainitic transformation temperature is increased, the hardness of the head surface of the rail decreases, and it become difficult to ensure the surface damage resistance. In addition, when the accelerated-cooling is stopped in a state in which temperature of the head surface of the material rail excesses 500° C., since pearlite structures are generated just after termination of the accerelated-cooling, rolling contact fatigue damage is easily generated, and the surface damage resistance of the head surface portion of the rail degrades. In addition, when the head surface of the material rail is acceleratively-cooled to lower than 350° C., the bainitic transformation temperature is lowered, and the hardness of bainite structures excessively increases. In addition, when the head surface of the material rail is acceleratively-cooled to lower than 350° C., the bainitic transformation rate is decreased, bainitic transformation does not completely finish, and martensite structures are generated. As a result, rolling contact fatigue damage is easily generated, and the surface damage resistance and wear resistance of the head surface portion of the rail degrades. Therefore, the stoppage temperature of the accelerated-cooling is limited to a range of 350° C. to 500° C.

<4> Range of Holding Time

A production method for a rail according to the present embodiment includes holding a temperature of the head surface of the material rail in the temperature region of 350° C. to 500° C. for 100 sec to 800 sec after stopping the accelerated-cooling the head surface of the material rail in a range of 350° C. to 500° C. The reasons for limiting the holding time within 100 sec to 800 sec during holding will be described.

When the holding time is shorter than 100 sec, bainitic transformation does not completely finish and martensite structures are generated. As a result, rolling contact fatigue damage is easily generated, and the surface damage resistance of the head surface portion of the rail degrades. In addition, when the holding time is longer than 800 sec, bainite structures are tempered and the hardness decreases, and thus, it becomes difficult to ensure the surface damage resistance of the head surface portion of the rail. Therefore, the holding time after the accerelated-cooling is limited to 100 sec or longer and 800 sec or shorter.

Meanwhile, in the temperature holding after the accelerated-cooling, it is possible to obtain preferable metallographic structures and hardness by selecting any temperature in the range of 350° C. to 500° C. Therefore, the temperature may be isothermally-holded or may change in range of 350° C. to 500° C. during the temperature holding.

The material rail is naturally-cooled to room temperature after the temperature holding in the above-described range of 350° C. to 500° C., in which, since the metallographic structures formed by the temperature holding is not substantially affected by the cooling condition, the cooling condition is not limited. Therefore, in a production method for a rail according to the present embodiment, either naturally-cooling or accerelated-cooling can be performed after the temperature holding.

When the above-described production conditions (heat treatment conditions) are employed, it is possible to produce the rail according to the present embodiment.

In the production method of a rail according to the present embodiment, the "cooling rate" refers to a value obtained by dividing the difference between the cooling start temperature and the cooling end temperature by the cooling time.

In the production method for a rail according to the present embodiment, in order to generate 98% by area or more of bainite structures in the head surface portion of the rail requiring surface damage resistance and wear resistance, the production conditions are limited. That is, structures in portions other than the head surface portion (for example, the foot portion and the like of the rail) in which surface damage resistance and wear resistance are not essential may not include 98% by area or more of bainite structures. Therefore, in heat treatments in which the cooling conditions of the head surface of the material rail are regulated, the production conditions (heat treatment conditions) of portions other than the head surface of the material rail are not limited. Therefore, portions other than the head surface of the material rail may not be cooled under the above-described cooling conditions.

EXAMPLES

Next, examples of the present invention will be described. Meanwhile, conditions in the present examples are examples of conditions employed to confirm the feasibility and effects of the present invention, and the present invention is not limited to these condition examples. The present invention is allowed to employ a variety of conditions within the scope of the gist of the present invention as long as the object of the present invention is achieved.

Example 1

Tables 1 and 2 show the chemical components of rails (examples, Steels No. A1 to A44) in the scope of the present invention. Table 3 shows the chemical components of rails (comparative examples, Steels No. B1 to B18) outside the scope of the present invention. Underlined values in the tables indicate numeric values outside the ranges regulated in the present invention. In addition, values of Mn/Cr calculated from the values of the chemical components (mass %) are described in the Tables 1 to 3.

Figure 12:
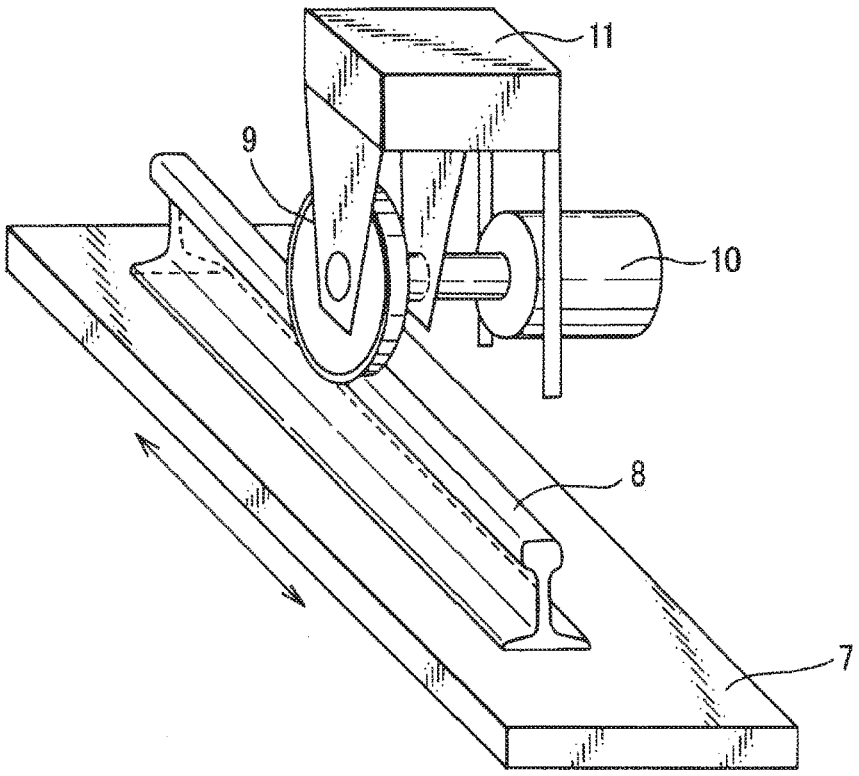
FIG. 12 is a schematic perspective view showing an outline of a rolling contact fatigue test.

In addition, Tables 4 to 6 show various characteristics (structures at places of a depth of 2 mm from the head surface and at places of a depth of 10 mm from the head surface, hardness at places of a depth of 2 mm from the head surface and at places of a depth of 10 mm from the head surface, the results of wear tests repeated 500,000 times using a method shown in FIG. 11, and the results of rolling contact fatigue tests repeated a maximum of 2.0 million times using a method shown in FIG. 12) of the rails shown in Tables 1 to 3 (Steels No. A1 to A44 and Steels No. B1 to B18).

Figure 10:
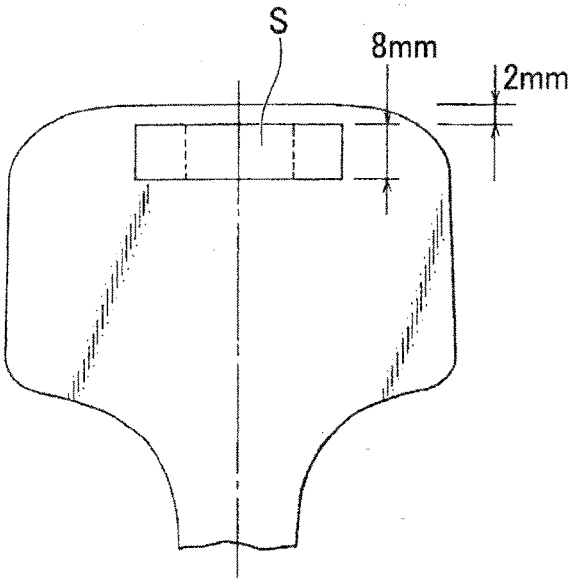
FIG. 10 is a schematic cross sectional view of a rail head portion for describing a sampling location of a cylindrical test specimen for carrying out a wear test.

Meanwhile, FIG. 10 is a cross-sectional view of a rail and shows a sampling location of test specimens used in wear tests shown in FIG. 11. As shown in FIG. 10, 8 mm-thick cylindrical test specimens were cut out from the head surface portions of test rails so that the upper surfaces of the cylindrical test specimens were located 2 mm below the head surfaces of the test rails and the lower surfaces of the cylindrical test specimens were located 10 mm below the head surfaces of the test rails.

In the tables, in places where metallographic structures are disclosed, bainite is represented by "B", pearlite is represented by "P", martensite is represented by "M". Structure of an example in which "B" is described includes 98% by area or more of bainite. Structure of an example in which "B+M", "B+P", or "B+P+M" is described includes less than 98% by area of bainite and more than 2% by area in total of martensite and/or pearlite. An example in which both of structures at place of a depth of 2 mm below the surface of the head surface portion and place of a depth of 10 mm below the surface are indicated as "B" is assumed as an example of which the structure is within the range of the present invention.

In the tables, the hardness at places of a depth of 2 mm below the surface of the head surface portion and places of a depth of 10 mm below the surface is indicated in the unit of Hv. Examples in which hardness at places of a depth of 2 mm below the surface of the head surface portion and hardness at places of a depth of 10 mm below the surface of the head surface portion are both Hv 380 to Hv 500 are considered to be examples in which hardness is within the regulation range of the present invention.

In the tables, the results of wear tests (wear amounts after the end of wear tests) are indicated in the unit of g.

In the tables, the results of rolling contact fatigue tests (the number of repetitions until fatigue damage is generated in rolling contact fatigue tests) are indicated in the unit of 10,000 times. Examples in which the results of rolling contact fatigue tests are described as "-" were examples in which, when rolling contact fatigue tests having a maximum repeat count of 2.0 million times end, fatigue damage is not generated and fatigue damage resistance is favorable.

<Method for Carrying Out Wear Tests for Steels No. A1 to A44 and Steels No. B1 to B18 and Acceptance Criteria>

Tester: Nishihara-type wear tester (see FIG. 11)

Test specimen shape: Cylindrical test specimen (outer diameter: 30 mm, thickness: 8 mm), a rail material 4 in FIG. 11

Test specimen-sampling location: 2 mm below the head surfaces of rails (see FIG. 10)

Contact surface pressure: 840 MPa

Slip ratio: 9%

Opposite material: Pearlite steel (Hv 380), a wheel material 5 in FIG. 11

Test atmosphere: Air atmosphere

Cooling method: Forced cooling using compressed air in which a cooling air nozzle 6 in FIG. 11 was used (flow rate: 100 Nl/min).

The number of repetitions: 500,000 times

Acceptance criteria: Examples in which the wear amounts were 1 g or more were considered to be examples in which the wear resistance was outside the regulation range of the present invention.

<Method for Carrying Out Rolling Contact Fatigue Tests for Steels No. A1 to A44 and Steels No. B1 to B18 and Acceptance Criteria>

Tester: A rolling contact fatigue tester (see FIG. 12)

Test specimen shape: A rail (2 m 141 pound rail), a test rail 8 in FIG. 12

Wheel: Association of American Railroads (AAR)-type (diameter: 920 mm), a wheel 9 in FIG. 12

Radial load and Thrust load: 50 kN to 300 kN, and 100 kN, respectively

Lubricant: Dry+oil (intermittent oil supply)

The number of times of rolling: Until damage was generated (in a case in which damage was not generated, a maximum of 2.0 million times)

Acceptance criteria: Examples in which surface damage was generated during rolling contact fatigue tests were considered to be examples of which the fatigue damage resistance was outside the regulation range of the present invention.

<Hardness Measurement Method for Steels No. A1 to A44 and Steels No. B1 to B18>

Test specimens for measurement: Test specimens cut out from transverse sections of rail head portions including head surface portions Pretreatment: Cross sections were diamond-polished.

Device: A Vickers hardness tester was used (the load was 98 N).

Measurement method: According to JIS Z 2244

Measurement method for hardness at locations of depth of 2 mm from the head surfaces: Hardness at arbitrary 20 places at depth of 2 mm from the head surfaces was measured, and the hardness values were averaged, thereby obtaining the hardness.

Measurement method for hardness at locations of depth of 10 mm from the head surfaces: Hardness at arbitrary 20 places at depth of 10 mm from the head surfaces was measured, and the hardness values were averaged, thereby obtaining the hardness.

<Structure Observation Method for Steels No. A1 to A44 and Steels No. B1 to B18>

Pretreatment: Cross sections were diamond-polished, and then were etched using 3% Nital.

Structure observation: An optical microscope was used.

Measurement method for bainite area ratios in regions from head surface to depth of 10 mm: The bainite area ratios at 20 places at depth of 2 mm from the head surfaces and the bainite area ratios at 20 places at depth of 10 mm from the head surfaces were obtained on the basis of optical microscopic photographs respectively, and the area ratios were averaged, thereby obtaining the values at the respective locations.

The outline of the manufacturing process and the production conditions of rails of examples and comparative examples shown in Tables 4 to 6 is as described below.

<Outline of Manufacturing Process>

Production method 1 (abbreviated as "<1>" in the tables): The chemical components of molten steel were adjusted and molten steel were cast, and bloom or slab were reheated in a temperature range of 1,250° C. to 1,300° C., were hot-rolled, and were heat-treated.

Production method 2 (abbreviated as "<2>" in the tables): The chemical components of molten steel were adjusted and molten steel were cast, bloom or slab were reheated in a temperature range of 1,250° C. to 1,300° C., were hot-rolled, and were preliminarily cooled, cooled to normal temperature, thereby producing material rails, and then head surfaces were reheated to the austenite transformation completion temperature+30° C. or higher and were heat-treated.

<Head Surface Portion Heat Treatment Conditions>

Cooling start temperature: 750° C.

Accelerated-cooling rate: 8.0° C./sec

Accelerated-cooling stoppage temperature: 430° C.

Holding time: 400 sec

The details of rails of examples and comparative examples shown in Tables 1 to 3 will be as described below.

(1) Invention Rails (44 rails)

Symbols A1 to A44: Rails in which the chemical component values, values of Mn/Cr calculated by the chemical component values (mass %), microstructures in the head surface portions, and the hardness of the head surface portions were within the scope of the present invention.

(2) Comparative Rails (18 rails)

Symbols B1 to B10 (10 rails): Rails in which the amounts of C, Si, Mn, Cr, P, and S were outside the scope of the present invention.

Symbols B11 to B14 (4 rails): Rails in which the values of Mn/Cr were outside the scope of the present invention.

Symbols B15 to B18 (4 rails): Rails in which the amounts of Mn or S were outside the scope of the present invention.

TABLE 1

| | STEEL | CHEMICAL COMPONENTS (mass %) | | | | | | | | | | | | | | | | | | |
|---|---|---|---|---|---|---|---|---|---|---|---|---|---|---|---|---|---|---|---|---|
| | No. | C | Si | Mn | Cr | P | S | Mo | Co | Cu | Ni | V | Nb | Mg | Ca | REM | B | Zr | N | Mn/Cr |
| INVENTIVE EXAMPLES | A1 | 0.70 | 0.25 | 0.40 | 0.60 | 0.0120 | 0.0110 | — | — | — | — | — | — | — | — | — | — | — | — | 0.67 |
| | A2 | 1.00 | 0.25 | 0.40 | 0.60 | 0.0120 | 0.0110 | — | — | — | — | — | — | — | — | — | — | — | — | 0.67 |
| | A3 | 0.80 | 0.20 | 0.40 | 0.65 | 0.0180 | 0.0150 | — | — | — | — | — | — | — | — | — | — | — | — | 0.62 |
| | A4 | 0.80 | 1.50 | 0.40 | 0.65 | 0.0180 | 0.0150 | — | — | — | — | — | — | — | — | — | — | — | — | 0.62 |
| | A5 | 0.75 | 0.35 | 0.30 | 1.00 | 0.0150 | 0.0080 | — | — | — | — | — | — | — | — | — | — | — | — | 0.30 |
| | A6 | 0.75 | 0.35 | 1.00 | 1.00 | 0.0150 | 0.0080 | — | — | — | — | — | — | — | — | — | — | — | — | 1.00 |
| | A7 | 0.83 | 0.45 | 0.40 | 0.50 | 0.0150 | 0.0080 | — | — | — | — | — | — | — | — | — | — | — | — | 0.80 |
| | A8 | 0.83 | 0.45 | 0.40 | 1.30 | 0.0150 | 0.0080 | — | — | — | — | — | — | — | — | — | — | — | — | 0.31 |
| | A9 | 0.80 | 0.60 | 0.50 | 0.70 | 0.0250 | 0.0100 | — | — | — | — | — | — | — | — | — | — | — | — | 0.71 |
| | A10 | 0.80 | 0.25 | 0.40 | 0.50 | 0.0150 | 0.0250 | — | — | — | — | — | — | — | — | — | — | — | — | 0.80 |
| | A11 | 0.70 | 0.30 | 0.80 | 1.00 | 0.0120 | 0.0100 | — | — | — | — | — | — | — | — | — | — | — | — | 0.80 |
| | A12 | 0.70 | 0.30 | 0.80 | 1.00 | 0.0120 | 0.0100 | 0.02 | — | — | — | — | — | — | — | — | — | — | — | 0.80 |
| | A13 | 0.72 | 0.60 | 0.60 | 1.00 | 0.0120 | 0.0100 | — | — | — | — | — | — | — | — | — | — | — | — | 0.60 |
| | A14 | 0.72 | 0.60 | 0.60 | 1.00 | 0.0120 | 0.0100 | — | 0.10 | — | — | — | — | — | — | — | — | — | — | 0.60 |
| | A15 | 0.75 | 0.25 | 0.80 | 0.80 | 0.0150 | 0.0080 | — | — | — | — | — | — | — | — | — | — | — | — | 1.00 |
| | A16 | 0.75 | 0.25 | 0.80 | 0.80 | 0.0150 | 0.0080 | — | — | — | — | 0.05 | — | — | — | — | — | — | — | 1.00 |
| | A17 | 0.75 | 0.25 | 0.80 | 0.80 | 0.0150 | 0.0080 | — | — | — | — | 0.10 | — | — | — | — | — | — | — | 1.00 |
| | A18 | 0.77 | 1.00 | 0.70 | 0.75 | 0.0140 | 0.0080 | — | — | — | — | — | — | — | — | — | — | — | — | 0.93 |
| | A19 | 0.77 | 1.00 | 0.70 | 0.75 | 0.0140 | 0.0080 | — | — | — | — | — | — | — | — | — | 0.0010 | — | — | 0.93 |
| | A20 | 0.78 | 0.55 | 1.00 | 1.20 | 0.0110 | 0.0100 | — | — | — | — | — | — | — | — | — | — | — | — | 0.83 |

TABLE 2

| STEEL | CHEMICAL COMPONENTS (mass %) | | | | | | | | | | |
|---|---|---|---|---|---|---|---|---|---|---|---|
| No. | C | Si | Mn | Cr | P | S | Mo | Co | Cu | Ni | V |
| A21 | 0.79 | 1.20 | 0.50 | 0.80 | 0.0150 | 0.0080 | — | — | — | — | — |
| A22 | 0.79 | 1.20 | 0.50 | 0.80 | 0.0150 | 0.0080 | — | — | — | — | — |
| A23 | 0.80 | 0.70 | 0.50 | 0.65 | 0.0150 | 0.0150 | — | — | — | — | — |
| A24 | 0.80 | 0.70 | 0.50 | 0.65 | 0.0150 | 0.0150 | — | — | — | — | 0.05 |
| A25 | 0.81 | 0.45 | 0.60 | 1.20 | 0.0100 | 0.0050 | — | — | — | — | — |
| A26 | 0.81 | 0.60 | 0.30 | 1.00 | 0.0080 | 0.0070 | — | — | — | — | — |
| A27 | 0.81 | 0.60 | 0.30 | 1.00 | 0.0080 | 0.0070 | — | — | — | — | — |

TABLE 2-continued

| | | | | | | | | | | | |
|---|---|---|---|---|---|---|---|---|---|---|---|
| A28 | 0.82 | 0.25 | 0.60 | 1.20 | 0.0150 | 0.0140 | — | — | — | — | — |
| A29 | 0.82 | 0.25 | 0.60 | 1.20 | 0.0150 | 0.0140 | — | — | — | — | — |
| A30 | 0.82 | 0.45 | 1.00 | 1.10 | 0.0200 | 0.0050 | — | — | — | — | — |
| A31 | 0.82 | 0.45 | 1.00 | 1.10 | 0.0200 | 0.0050 | — | — | 0.10 | — | — |
| A32 | 0.83 | 0.55 | 0.35 | 0.60 | 0.0150 | 0.0120 | — | — | — | — | — |
| A33 | 0.83 | 0.55 | 0.35 | 0.60 | 0.0150 | 0.0120 | — | — | — | 0.10 | — |
| A34 | 0.84 | 0.75 | 0.50 | 0.60 | 0.0070 | 0.0080 | — | — | — | — | — |
| A35 | 0.84 | 0.75 | 0.50 | 0.60 | 0.0070 | 0.0080 | — | — | — | — | 0.08 |
| A36 | 0.85 | 0.50 | 0.30 | 0.80 | 0.0150 | 0.0140 | — | — | — | — | — |
| A37 | 0.85 | 0.50 | 0.30 | 0.80 | 0.0150 | 0.0140 | 0.02 | — | — | — | — |
| A38 | 0.86 | 0.90 | 0.45 | 0.65 | 0.0140 | 0.0090 | — | — | — | — | — |
| A39 | 0.87 | 0.70 | 0.30 | 0.50 | 0.0140 | 0.0150 | — | — | — | — | — |
| A40 | 0.87 | 0.70 | 0.30 | 0.50 | 0.0140 | 0.0150 | — | — | — | — | — |
| A41 | 0.90 | 1.10 | 0.90 | 1.00 | 0.0120 | 0.0120 | — | — | — | — | — |
| A42 | 0.92 | 0.50 | 0.75 | 0.85 | 0.0140 | 0.0150 | — | — | — | — | — |
| A43 | 0.95 | 0.65 | 0.45 | 0.60 | 0.0120 | 0.0080 | — | — | — | — | — |
| A44 | 1.00 | 0.35 | 0.50 | 0.65 | 0.0140 | 0.0150 | — | — | — | — | — |

| STEEL | CHEMICAL COMPONENTS (mass %) | | | | | | | |
|---|---|---|---|---|---|---|---|---|
| No. | Nb | Mg | Ca | REM | B | Zr | N | Mn/Cr |
| A21 | — | — | — | — | — | — | — | 0.63 |
| A22 | — | 0.0025 | 0.0015 | — | — | — | — | 0.63 |
| A23 | — | — | — | — | — | — | — | 0.77 |
| A24 | — | — | — | — | — | — | 0.0140 | 0.77 |
| A25 | — | — | — | — | — | — | — | 0.50 |
| A26 | — | — | — | — | — | — | — | 0.30 |
| A27 | — | — | — | — | — | 0.0012 | — | 0.30 |
| A28 | — | — | — | — | — | — | — | 0.50 |
| A29 | — | — | — | 0.0025 | — | — | — | 0.50 |
| A30 | — | — | — | — | — | — | — | 0.91 |
| A31 | — | — | — | — | — | — | — | 0.91 |
| A32 | — | — | — | — | — | — | — | 0.58 |
| A33 | — | — | — | — | — | — | — | 0.58 |
| A34 | — | — | — | — | — | — | — | 0.83 |
| A35 | — | — | — | — | — | — | — | 0.83 |
| A36 | — | — | — | — | — | — | — | 0.38 |
| A37 | — | — | — | — | 0.0010 | — | — | 0.38 |
| A38 | — | — | — | — | — | — | — | 0.69 |
| A39 | — | — | — | — | — | — | — | 0.60 |
| A40 | 0.0035 | — | — | — | — | — | — | 0.60 |
| A41 | — | — | — | — | — | — | — | 0.90 |
| A42 | — | — | — | — | — | — | — | 0.88 |
| A43 | — | — | — | — | — | — | — | 0.75 |
| A44 | — | — | — | — | — | — | — | 0.77 |

TABLE 3

| | STEEL | CHEMICAL COMPONENTS (mass %) | | | | | | | | | | | | | | | | | | |
|---|---|---|---|---|---|---|---|---|---|---|---|---|---|---|---|---|---|---|---|---|
| | No. | C | Si | Mn | Cr | P | S | Mo | Co | Cu | Ni | V | Nb | Mg | Ca | REM | B | Zr | N | Mn/Cr |
| COMPARATIVE EXAMPLE | B1 | 0.60 | 0.25 | 0.40 | 0.60 | 0.0120 | 0.0110 | — | — | — | — | — | — | — | — | — | — | — | — | 0.67 |
| | B2 | 1.05 | 0.25 | 0.40 | 0.60 | 0.0120 | 0.0110 | — | — | — | — | — | — | — | — | — | — | — | — | 0.67 |
| | B3 | 0.80 | 0.10 | 0.40 | 0.65 | 0.0180 | 0.0150 | — | — | — | — | — | — | — | — | — | — | — | — | 0.62 |
| | B4 | 0.80 | 2.00 | 0.40 | 0.65 | 0.0180 | 0.0150 | — | — | — | — | — | — | — | — | — | — | — | — | 0.62 |
| | B5 | 0.75 | 0.35 | 0.10 | 1.00 | 0.0150 | 0.0080 | — | — | — | — | — | — | — | — | — | — | — | — | 0.10 |
| | B6 | 0.75 | 0.35 | 1.50 | 1.00 | 0.0150 | 0.0080 | — | — | — | — | — | — | — | — | — | — | — | — | 1.50 |
| | B7 | 0.83 | 0.45 | 0.40 | 0.30 | 0.0150 | 0.0080 | — | — | — | — | — | — | — | — | — | — | — | — | 1.33 |
| | B8 | 0.83 | 0.45 | 0.40 | 1.90 | 0.0150 | 0.0080 | — | — | — | — | — | — | — | — | — | — | — | — | 0.21 |
| | B9 | 0.80 | 0.60 | 0.50 | 0.70 | 0.0350 | 0.0100 | — | — | — | — | — | — | — | — | — | — | — | — | 0.71 |
| | B10 | 0.80 | 0.25 | 0.40 | 0.50 | 0.0150 | 0.0300 | — | — | — | — | — | — | — | — | — | — | — | — | 0.80 |
| | B11 | 0.75 | 0.25 | 1.00 | 0.80 | 0.0150 | 0.0080 | — | — | — | — | — | — | — | — | — | — | — | — | 1.25 |
| | B12 | 0.77 | 1.00 | 0.90 | 0.75 | 0.0140 | 0.0080 | — | — | — | — | — | — | — | — | — | — | — | — | 1.20 |
| | B13 | 0.81 | 0.60 | 0.30 | 1.10 | 0.0080 | 0.0070 | — | — | — | — | — | — | — | — | — | — | — | — | 0.27 |
| | B14 | 0.85 | 0.50 | 0.30 | 1.20 | 0.0150 | 0.0140 | — | — | — | — | — | — | — | — | — | — | — | — | 0.25 |
| | B15 | 0.75 | 0.35 | 0.25 | 0.70 | 0.0150 | 0.0080 | — | — | — | — | — | — | — | — | — | — | — | — | 0.36 |
| | B16 | 0.75 | 0.35 | 1.10 | 1.20 | 0.0150 | 0.0080 | — | — | — | — | — | — | — | — | — | — | — | — | 0.92 |
| | B17 | 0.83 | 0.45 | 0.35 | 0.40 | 0.0150 | 0.0080 | — | — | — | — | — | — | — | — | — | — | — | — | 0.88 |
| | B18 | 0.83 | 0.45 | 0.50 | 1.40 | 0.0150 | 0.0080 | — | — | — | — | — | — | — | — | — | — | — | — | 0.36 |

TABLE 4

| | STEEL No. | STRUCTURE OF HEAD SURFACE PORTION 2 mm BELOW HEAD SURFACE | STRUCTURE OF HEAD SURFACE PORTION 10 mm BELOW HEAD SURFACE | HARDNESS OF HEAD SURFACE PORTION 2 mm BELOW HEAD SURFACE (Hv) | HARDNESS OF HEAD SURFACE PORTION 10 mm BELOW HEAD SURFACE (Hv) | RESULTS OF WEAR TEST WEAR AMOUNT (g) | RESULTS OF ROLLING CONTACT FATIGUE TEST NUMBER UNTIL FATIGUE DAMAGE IS GENERATED (TEN THOUSAND TIMES) | PRODUCTION METHOD |
|---|---|---|---|---|---|---|---|---|
| INVENTIVE EXAMPLES | A1 | B | B | 390 | 380 | 0.70 | — | <1> |
| | A2 | B | B | 430 | 398 | 0.40 | — | <1> |
| | A3 | B | B | 405 | 390 | 0.58 | — | <1> |
| | A4 | B | B | 445 | 410 | 0.50 | — | <1> |
| | A5 | B | B | 411 | 389 | 0.57 | — | <1> |
| | A6 | B | B | 485 | 435 | 0.49 | — | <1> |
| | A7 | B | B | 410 | 385 | 0.51 | — | <2> |
| | A8 | B | B | 490 | 450 | 0.44 | — | <2> |
| | A9 | B | B | 435 | 400 | 0.55 | — | <1> |
| | A10 | B | B | 400 | 385 | 0.59 | — | <1> |
| | A11 | B | B | 435 | 400 | 0.62 | — | <1> |
| | A12 | B | B | 445 | 410 | 0.58 | — | <1> |
| | A13 | B | B | 435 | 402 | 0.56 | — | <2> |
| | A14 | B | B | 435 | 402 | 0.50 | — | <2> |
| | A15 | B | B | 425 | 398 | 0.53 | — | <1> |
| | A16 | B | B | 425 | 405 | 0.53 | — | <1> |
| | A17 | B | B | 425 | 410 | 0.53 | — | <1> |
| | A18 | B | B | 450 | 421 | 0.50 | — | <1> |
| | A19 | B | B | 455 | 421 | 0.49 | — | <1> |
| | A20 | B | B | 500 | 475 | 0.41 | — | <1> |

TABLE 5

| | STEEL No. | STRUCTURE OF HEAD SURFACE PORTION 2 mm BELOW HEAD SURFACE | STRUCTURE OF HEAD SURFACE PORTION 10 mm BELOW HEAD SURFACE | HARDNESS OF HEAD SURFACE PORTION 2 mm BELOW HEAD SURFACE (Hv) | HARDNESS OF HEAD SURFACE PORTION 10 mm BELOW HEAD SURFACE (Hv) | RESULTS OF WEAR TEST WEAR AMOUNT (g) | RESULTS OF ROLLING CONTACT FATIGUE TEST NUMBER UNTIL FATIGUE DAMAGE IS GENERATED (TEN THOUSAND TIMES) | PRODUCTION METHOD |
|---|---|---|---|---|---|---|---|---|
| INVENTIVE EXAMPLES | A21 | B | B | 435 | 412 | 0.48 | — | <1> |
| | A22 | B | B | 470 | 445 | 0.48 | — | <1> |
| | A23 | B | B | 440 | 410 | 0.51 | — | <1> |
| | A24 | B | B | 440 | 430 | 0.51 | — | <1> |
| | A25 | B | B | 482 | 445 | 0.44 | — | <1> |
| | A26 | B | B | 445 | 415 | 0.50 | — | <1> |
| | A27 | B | B | 445 | 415 | 0.50 | — | <1> |
| | A28 | B | B | 460 | 423 | 0.48 | — | <1> |
| | A29 | B | B | 465 | 423 | 0.48 | — | <1> |
| | A30 | B | B | 480 | 465 | 0.45 | — | <2> |
| | A31 | B | B | 485 | 475 | 0.45 | — | <2> |
| | A32 | B | B | 405 | 385 | 0.50 | — | <2> |
| | A33 | B | B | 410 | 385 | 0.50 | — | <2> |
| | A34 | B | B | 395 | 380 | 0.52 | — | <1> |
| | A35 | B | B | 395 | 390 | 0.52 | — | <1> |
| | A36 | B | B | 420 | 390 | 0.50 | — | <1> |
| | A37 | B | B | 430 | 400 | 0.49 | — | <1> |
| | A38 | B | B | 425 | 395 | 0.44 | — | <1> |
| | A39 | B | B | 400 | 385 | 0.45 | — | <1> |
| | A40 | B | B | 400 | 390 | 0.45 | — | <1> |
| | A41 | B | B | 465 | 440 | 0.38 | — | <1> |
| | A42 | B | B | 450 | 435 | 0.38 | — | <2> |
| | A43 | B | B | 430 | 410 | 0.40 | — | <1> |
| | A44 | B | B | 410 | 390 | 0.41 | — | <1> |

TABLE 6

| | STEEL No. | STRUCTURE OF HEAD SURFACE PORTION 2 mm BELOW HEAD SURFACE | STRUCTURE OF HEAD SURFACE PORTION 10 mm BELOW HEAD SURFACE | HARDNESS OF HEAD SURFACE PORTION 2 mm BELOW HEAD SURFACE (Hv) | HARDNESS OF HEAD SURFACE PORTION 10 mm BELOW HEAD SURFACE (Hv) | RESULTS OF WEAR TEST WEAR AMOUNT (g) | RESULTS OF ROLLING CONTACT FATIGUE TEST NUMBER UNTIL FATIGUE DAMAGE IS GENERATED (TEN THOUSAND TIMES) | PRODUCTION METHOD |
|---|---|---|---|---|---|---|---|---|
| COMPARATIVE EXAMPLE | B1 | B | B | 370 | 350 | 2.00 | 125 | <1> |
| | B2 | B | B | 445 | 410 | 0.19 | 60 | <1> |
| | B3 | B | B | 375 | 360 | 0.60 | 130 | <1> |
| | B4 | B + M | B | 525 | 420 | 2.43 | 45 | <1> |
| | B5 | B + M | B | 552 | 489 | 2.65 | 30 | <1> |
| | B6 | B + P | B + P | 465 | 430 | 0.20 | 50 | <1> |
| | B7 | B + P | B + P | 425 | 400 | 0.24 | 70 | <2> |
| | B8 | B + M | B + M | 542 | 500 | 2.56 | 35 | <2> |
| | B9 | B | B | 435 | 400 | 0.55 | 145 | <1> |
| | B10 | B | B | 400 | 385 | 0.59 | 125 | <1> |
| | B11 | B + P | B | 415 | 405 | 0.53 | 80 | <1> |
| | B12 | B + P | B | 430 | 412 | 0.50 | 72 | <1> |
| | B13 | B + M | B | 510 | 450 | 2.35 | 45 | <1> |
| | B14 | B + M | B + M | 498 | 489 | 2.30 | 55 | <1> |
| | B15 | B | B | 360 | 335 | 0.65 | 115 | <1> |
| | B16 | B + M | B | 530 | 489 | 2.45 | 45 | <1> |
| | B17 | B | B | 375 | 350 | 0.62 | 125 | <2> |
| | B18 | B + M | B + M | 510 | 500 | 2.10 | 45 | <2> |

As shown in Tables 1 to 6, in the rails of the present examples (symbols A1 to A44) in which the amounts of the respective alloy elements are in the regulation ranges of the present invention, in the head surface portions of the rails, the generation of pearlite structures, pro-eutectoid ferrite structures, pro-eutectoid cementite structures, and martensite structures was suppressed, structures of the head surface portions included 98% by area or more of bainite structures, and the wear resistance and the surface damage resistance were higher than the rails of comparative examples (symbols B1 to B18). In addition, as shown in Tables 1 to 6, in the rail steel of the present examples (symbols A1 to A44) in which the chemical components of the steel and the values of Mn/Cr were controlled, since generation of the pearlite structures and the martensite structures was suppressed and the hardness of the head surface portions of the rails were controlled, the surface damage resistance and the wear resistance were higher than the rail steel of comparative examples (symbols B1 to B18).

On the other hand, in comparative example B1 in which the amount of C was insufficient, the wear amount was large and surface damage resistance was deteriorated due to lack of hardness.

In comparative example B2 in which the amount of C was excessive, the wear amount was insufficient, and thus the surface damage resistance was deteriorated.

In comparative example B3 in which Si was insufficient, the bainite was softened, and thus the surface damage resistance was deteriorated.

In comparative example B4 in which Si was excessive, excessive amount of martensite was generated, and thus wear amount increased and the surface damage resistance was deteriorated.

In comparative example B5 in which Mn and Mn/Cr were insufficient, excessive amount of martensite was generated, and thus wear amount became excessive and the surface damage resistance was deteriorated.

In comparative example B6 in which Mn and Mn/Cr were excessive, excessive amount of pearlite was generated, and thus the surface damage resistance was deteriorated.

In comparative example B7 in which Cr was insufficient and Mn/Cr was excessive, excessive amount of pearlite was generated, and thus the surface damage resistance was deteriorated.

In comparative example B8 in which Cr was excessive and Mn/Cr was insufficient, excessive amount of martensite was generated, and thus wear amount became excessive and the surface damage resistance was deteriorated.

In comparative example B9 in which P was excessive, embrittlement of structure occurred, and thus the surface damage resistance was deteriorated.

In comparative example B10 in which S was excessive, coarse inclusions were generated, and thus the surface damage resistance was deteriorated.

In comparative examples B11 and B12 in which Mn/Cr was excessive, excessive amount of pearlite was generated, and thus the surface damage resistance was deteriorated.

In comparative examples B13 and B14 in which Mn/Cr was insufficient, excessive amount of martensite was generated, and thus wear amount became excessive and the surface damage resistance was deteriorated.

In comparative example B15 in which Mn was insufficient, the bainite was softened, and thus the surface damage resistance was deteriorated.

In comparative example B16 in which Mn content was excessive, excessive amount of martensite was generated, and thus wear amount became excessive and the surface damage resistance was deteriorated.

In comparative example B17 in which Cr content was insufficient, the bainite was softened, and thus the surface damage resistance was deteriorated.

In comparative example B18 in which Cr was excessive, excessive amount of martensite was generated, and thus wear amount became excessive and the surface damage resistance was deteriorated.

Example 2

Next, rails (No. C1 to C23) were produced under a variety of production conditions as shown in Table 7 using steel having the same chemical components (all are chemical components in the regulation ranges of the present invention) as those of No. A13, A18, A21, and A28 shown in Tables 1 and 2. Table 7 shows the heat treatment conditions (the cooling start temperatures, the accelerated-cooling rates, the accelerated-cooling stoppage temperatures, and the holding times) of the head surface of Examples No. C1 to C23. In the production of Example C7, the temperature was increased due to heat recovery after the accelerated-cooling, and the temperature was not held to be constant, and thus the holding time of Example C7 is not shown in Table 7.

Table 8 shows various characteristics of the respective obtained rails (Steel No. C1 to C23). Table 8 shows the structures in the head surface portions, the hardness of the head surface portions, results of the wear test performed by the method shown in FIG. 11, and results of the rolling contact fatigue test performed by the method shown in FIG. 12 in the same manner as in Tables 4 to 6. In Table 8, in places where metallographic structures are disclosed, numeric values next to a symbol "B" indicate the amounts of bainite. An example in which numeric value is not described next to the symbol "B" had 98% by area or more of bainite at places for observing metallographic structures.

In addition, the methods for carrying out wear tests and the acceptance criteria, the methods for carrying out rolling contact fatigue tests and the acceptance criteria, the hardness measurement methods for the head surface portions of the rails, and the structure observation methods for Steels No. C1 to C23 were the same as those for Steels No. A1 to A44 and Steels No. B1 to B18.

As shown in Table 8, in Examples C1, C2, C4, C5, C8, C9, C16, and C17 in which the heat treatment was carried out while conditions for head surfaces (the cooling start temperatures, the accelerated-cooling rates, the accelerated-cooling stoppage temperatures, and the holding times) were within the scope of the present invention, generation of pearlite structures, martensite structures, and the like and softening of bainite structures were suppressed, and hardness of the head surface portions of the rails were appropriately controlled, and thus the rails had favorable wear resistance and surface damage resistance.

In Comparative Example C3 in which the cooling start temperature was lower than the defined range, the pearlite was generated, and thus the fatigue damage resistance was deteriorated.

In Comparative Example C6 in which the accelerated-cooling rate was slower than the determined range, the pearlite was generated, and thus the fatigue damage resistance was deteriorated.

In Comparative Example C7 in which the accelerated-cooling rate was faster than the defined range, temperature rised by heat recovery after the accelerated-cooling and isothermal-holding could not appropriately performed, and thus the bainite was softened and the fatigue damage resistance was deteriorated.

In Comparative Examples C10 to C12 in which the accelerated-cooling stoppage temperatures were higher than the defined range, the pearlite was generated, and thus the fatigue damage resistance was deteriorated.

In Comparative Examples C13 to C15 in which the accelerated-cooling stoppage temperatures were lower than the defined range, the martensite was generated, and thus the fatigue damage resistance and wear resistance were deteriorated.

In Comparative Examples C18 to C20 in which the isothermal-holding times were shorter than the defined range, the martensite was generated, and thus the fatigue damage resistance and wear resistance were deteriorated.

In Comparative Examples C21 to C23 in which the isothermal-holding times were longer than the defined range, the bainite was softened and the fatigue damage resistance was deteriorated.

TABLE 7

| | | | HEAT TREATMENT CONDITION ON HEAD PORTION | | | |
|---|---|---|---|---|---|---|
| | No. | COMPOSITION | COOLING START TEMPERATURE (° C.) | ACCELERATED-COOLING RATE (° C./sec) | ACCELERATED-COOLING STOPPAGE TEMPERATURE (° C.) | HOLDING TIME (sec) |
| INVENTIVE | C1 | A13 | 700 | 8.0 | 430 | 400 |
| EXAMPLES | C2 | | 750 | 5.0 | 450 | 500 |
| COMPARATIVE | C3 | | 600 | 5.0 | 450 | 500 |
| EXAMPLE | | | | | | |
| INVENTIVE | C4 | A18 | 700 | 8.0 | 430 | 400 |
| EXAMPLES | C5 | | 650 | 10.0 | 430 | 400 |
| COMPARATIVE | C6 | | 650 | 2.0 | 430 | 400 |
| EXAMPLE | C7 | | 650 | 25.0 | 430 | |
| INVENTIVE | C8 | A21 | 700 | 8.0 | 430 | 400 |
| EXAMPLES | C9 | | 700 | 8.0 | 460 | 200 |
| COMPARATIVE | C10 | | 700 | 8.0 | 560 | 200 |
| EXAMPLE | C11 | | 700 | 8.0 | 520 | 200 |
| | C12 | | 700 | 8.0 | 510 | 200 |
| | C13 | | 700 | 8.0 | 340 | 200 |
| | C14 | | 700 | 8.0 | 320 | 200 |
| | C15 | | 700 | 8.0 | 290 | 200 |
| INVENTIVE | C16 | A28 | 700 | 8.0 | 430 | 400 |
| EXAMPLES | C17 | | 800 | 15.0 | 400 | 300 |
| COMPARATIVE | C18 | | 800 | 15.0 | 400 | 50 |
| EXAMPLE | C19 | | 800 | 15.0 | 400 | 80 |
| | C20 | | 800 | 15.0 | 400 | 95 |
| | C21 | | 800 | 15.0 | 400 | 910 |
| | C22 | | 800 | 15.0 | 400 | 900 |
| | C23 | | 800 | 15.0 | 400 | 1000 |

TABLE 8

| | No. | STRUCTURE OF HEAD SURFACE PORTION 2 mm BELOW HEAD SURFACE | STRUCTURE OF HEAD SURFACE PORTION 10 mm BELOW HEAD SURFACE | HARDNESS OF HEAD SURFACE PORTION 2 mm BELOW HEAD SURFACE (Hv) | HARDNESS OF HEAD SURFACE PORTION 10 mm BELOW HEAD SURFACE (Hv) | RESULTS OF WEAR TEST WEAR AMOUNT (g) | RESULTS OF ROLLING CONTACT FATIGUE TEST NUMBER UNTIL FATIGUE DAMAGE IS GENERATED (TEN THOUSAND TIMES) |
|---|---|---|---|---|---|---|---|
| INVENTIVE | C1 | B | B | 435 | 402 | 0.56 | — |
| EXAMPLES | C2 | B | B | 425 | 400 | 0.58 | — |
| COMPARATIVE | C3 | B(85%) − P | B(80%) + P | 415 | 395 | 0.25 | 70 |
| EXAMPLE | | | | | | | |
| INVENTIVE | C4 | B | B | 450 | 421 | 0.50 | — |
| EXAMPLES | C5 | B | B | 442 | 418 | 0.51 | — |
| COMPARATIVE | C6 | B(60%) − P | B(55%) + P | 423 | 400 | 0.27 | 62 |
| EXAMPLE | C7 | B | B | 360 | 340 | 0.70 | 115 |
| INVENTIVE | C8 | B | B | 435 | 412 | 0.48 | — |
| EXAMPLES | C9 | B | B | 425 | 398 | 0.50 | — |
| COMPARATIVE | C10 | B(65%) − P | B(60%) + P | 401 | 380 | 0.30 | 85 |
| EXAMPLE | C11 | B(90%) − P | B(88%) + P | 360 | 340 | 0.30 | 60 |
| | C12 | B(96%) − P | B(95%) + P | 370 | 350 | 0.30 | 180 |
| | C13 | B(96%) + M | B(95%) + M | 495 | 450 | 0.59 | 170 |
| | C14 | B(70%) + M | B(65%) + M | 525 | 480 | 0.85 | 55 |
| | C15 | B(60%) + M | B(55%) + M | 545 | 495 | 2.45 | 45 |
| INVENTIVE | C16 | B | B | 460 | 423 | 0.48 | — |
| EXAMPLES | C17 | B | B | 435 | 405 | 0.52 | — |
| COMPARATIVE | C18 | B(75%) + M | B(70%) + M | 543 | 512 | 2.80 | 30 |
| EXAMPLE | C19 | B(90%) + M | B(85%) + M | 520 | 485 | 0.80 | 70 |
| | C20 | B(97%) + M | B(95%) + M | 480 | 445 | 0.60 | 185 |
| | C21 | B | B | 375 | 360 | 0.55 | 130 |
| | C22 | B | B | 360 | 350 | 0.60 | 125 |
| | C23 | B | B | 350 | 345 | 0.65 | 120 |

BRIEF DESCRIPTION OF THE REFERENCE SYMBOLS

1: TOP HEAD PORTION
2: CORNER HEAD PORTION
3: RAIL HEAD PORTION
3*a*: HEAD SURFACE PORTION (REGION FROM SURFACES OF CORNER HEAD PORTION AND TOP HEAD PORTION TO DEPTH OF 10 MM, SHADOW PORTION)
4: RAIL MATERIAL
5: WHEEL MATERIAL
6: AIR NOZZLE FOR COOLING
7: SLIDER FOR RAIL MOVEMENT
8: TEST RAIL
9: WHEEL
10: MOTOR
11: LOAD CONTROL DEVICE
12: SIDE HEAD PORTION

What is claimed is:

1. A rail comprising:

a rail head portion having a top head portion which is a flat region extending toward a top portion of the rail head portion in a extending direction of the rail, a side head portion which is a flat region extending toward a side portion of the rail head portion in the extending direction of the rail, and a corner head portion which is a region combining a rounded corner portion extending between the top head portion and the side head portion and an upper half of the side head portion, wherein the rail consists of, as a chemical components, in terms of mass %:

C: 0.70% to 1.00%,
Si: 0.20% to 1.50%,
Mn: 0.30% to 1.00%,
Cr: 0.50% to 1.30%,
P: 0.0250% or less,
S: 0.0250% or less,
Mo: 0% to 0.50%,
Co: 0% to 1.00%,
Cu: 0% to 1.00%,
Ni: 0% to 1.00%,
V: 0% to 0.300%,
Nb: 0% to 0.0500%,
Mg: 0% to 0.0200%,
Ca: 0% to 0.0200%,
REM: 0% to 0.0500%,
B: 0% to 0.0050%,
Zr: 0% to 0.0200%,
N: 0% to 0.0200%, and
a remainder of Fe and impurities, wherein a value of Mn/Cr, which is a ratio of Mn content with respect to Cr content, is within a range of 0.30 to 1.00, wherein structures in a region from a head surface constituted of a surface of the top head portion and a surface of the corner head portion to a depth of 10 mm includes 98% by area or more of bainite structures, and wherein an average hardness of the region from the head surface to a depth of 10 mm is in a range of Hv 380 to Hv 500.

2. The rail according to claim 1, wherein the rail contains as the chemical components, in terms of mass %, one or more selected from the group consisting of:

Mo: 0.01% to 0.50%,
Co: 0.01% to 1.00%,
Cu: 0.05% to 1.00%,
Ni: 0.05% to 1.00%,
V: 0.005% to 0.300%,

Nb: 0.0010% to 0.0500%,
Mg: 0.0005% to 0.0200%,
Ca: 0.0005% to 0.0200%,
REM: 0.0005% to 0.0500%,
B: 0.0001% to 0.0050%,
Zr: 0.0001% to 0.0200%, and
N: 0.0060% to 0.0200%.

3. A production method for a rail, comprising:

hot-rolling a bloom or a slab in a rail shape to obtain a material rail, accelerated-cooling the head surface of the material rail from a temperature region of 700° C. or higher which is a temperature region that is equal to or higher than a transformation start temperature from austenite to a temperature region of 350° C. to 500° C. at a cooling rate of 3.0° C./sec to 20.0° C./sec after the hot-rolling, holding a temperature of the head surface of the material rail in the temperature region of 350° C. to 500° C. for 100 sec to 800 sec after the accelerated-cooling, and naturally-cooling or further accelerated-cooling the material rail to room temperature after the holding, wherein the bloom or the slab contains, as a chemical components, in terms of mass %;

C: 0.70% to 1.00%,
Si: 0.20% to 1.50%,
Mn: 0.30% to 1.00%,
Cr: 0.50% to 1.30%,
P: 0.0250% or less,
S: 0.0250% or less,
Mo: 0% to 0.50%,
Co: 0% to 1.00%,
Cu: 0% to 1.00%,
Ni: 0% to 1.00%,
V: 0% to 0.300%,
Nb: 0% to 0.0500%,
Mg: 0% to 0.0200%,
Ca: 0% to 0.0200%,
REM: 0% to 0.0500%,
B: 0% to 0.0050%,
Zr: 0% to 0.0200%,
N: 0% to 0.0200%, and a remainder of Fe and impurities, and wherein a value of Mn/Cr, which is a ratio of Mn content with respect to Cr content, is within a range of 0.30 to 1.00.

4. The production method for a rail according to claim 3, further comprising:

preliminarily-cooling the hot-rolled rail and then reheating the head surface of the material rail to an austenite transformation completion temperature+30° C. or higher between the hot-rolling and the accelerated-cooling.

5. A production method for a rail, comprising:

hot-rolling a bloom or a slab in a rail shape to obtain a material rail, accelerated-cooling the head surface of the material rail from a temperature region of 700° C. or higher which is a temperature region that is equal to or higher than a transformation start temperature from austenite to a temperature region of 350° C. to 500° C. at a cooling rate of 3.0° C./sec to 20.0° C./sec after the hot-rolling, holding a temperature of the head surface of the material rail in the temperature region of 350° C. to 500° C. for 100 sec to 800 sec after the accelerated-cooling, and naturally-cooling or further accelerated-cooling the material rail to room temperature after the holding, wherein the bloom or the slab contains, as a chemical components, in terms of mass %:

C: 0.70% to 1.00%,
Si: 0.20% to 1.50%,
Mn: 0.30% to 1.00%,
Cr: 0.50% to 1.30%,
P: 0.0250% or less,
S: 0.0250% or less, one or more selected from the group consisting of:

Mo: 0.01% to 0.50%,
Co: 0.01% to 1.00%,
Cu: 0.05% to 1.00%,
Ni: 0.05% to 1.00%,
V: 0.005% to 0.300%,
Nb: 0.0010% to 0.0500%,
Mg: 0.0005% to 0.0200%,
Ca: 0.0005% to 0.0200%,
REM: 0.0005% to 0.0500%,
B: 0.0001% to 0.0050%,
Zr: 0.0001% to 0.0200%, and
N: 0.0060% to 0.0200%, and a remainder of Fe and impurities, and wherein a value of Mn/Cr, which is a ratio of Mn content with respect to Cr content, is within a range of 0.30 to 1.00.

6. The production method for a rail according to claim 5, further comprising:

preliminarily-cooling the hot-rolled rail and then reheating the head surface of the material rail to an austenite transformation completion temperature+30° C. or higher between the hot-rolling and the accelerated-cooling.

* * * * *